US006845802B1

(12) United States Patent
Anderson et al.

(10) Patent No.: US 6,845,802 B1
(45) Date of Patent: Jan. 25, 2005

(54) SELECTIVE TILTING ARRANGEMENT FOR A BLIND SYSTEM FOR COVERINGS FOR ARCHITECTURAL OPENINGS

(75) Inventors: Richard N. Anderson, Whitesville, KY (US); Robert E. Fisher, II, Owensboro, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/210,280

(22) Filed: Aug. 1, 2002

Related U.S. Application Data

(60) Provisional application No. 60/312,570, filed on Aug. 15, 2001.

(51) Int. Cl.[7] ..... E06B 3/48

(52) U.S. Cl. ..... 160/115; 160/177 R

(58) Field of Search ..... 160/115, 168.1 R, 160/173 R, 176.1 R, 177 R, 178.1 R

(56) References Cited

U.S. PATENT DOCUMENTS

| | | | | |
|---|---|---|---|---|
| 1,365,919 A | | 1/1921 | Jones | |
| 2,116,356 A | | 5/1938 | Laborda et al. | |
| 2,250,106 A | | 7/1941 | Lorentzen | |
| 2,427,266 A | | 9/1947 | Ewing | |
| 2,506,507 A | | 5/1950 | Kiatta | |
| 2,719,586 A | | 10/1955 | Graham | |
| 2,747,662 A | | 5/1956 | Reiners et al. | |
| 2,751,000 A | | 6/1956 | Mahan | |
| 3,111,164 A | * | 11/1963 | Lombard | 160/115 |
| 4,143,699 A | * | 3/1979 | Marotto | 160/176.1 R |
| 4,572,267 A | * | 2/1986 | Stein et al. | 160/176.1 R |
| 4,921,032 A | | 5/1990 | May | |
| 4,940,070 A | * | 7/1990 | Warden | 160/115 X |
| 5,205,335 A | * | 4/1993 | Horton et al. | 160/115 |
| 5,402,840 A | * | 4/1995 | Jortner et al. | 160/115 |
| 5,472,035 A | | 12/1995 | Biba et al. | |
| 5,485,874 A | | 1/1996 | Whitmore | |
| 5,934,350 A | * | 8/1999 | Ciuca | 160/176.1 R |
| 6,076,587 A | * | 6/2000 | Pastor | 160/115 |
| 6,105,652 A | | 8/2000 | Judkins | |
| 6,318,439 B1 | | 11/2001 | Matsubara | |
| 6,422,288 B1 | | 7/2002 | Dekker et al. | |
| 6,484,787 B1 | * | 11/2002 | Walters | 160/178.1 R |
| 6,581,665 B2 | * | 6/2003 | Lin | 160/115 |

FOREIGN PATENT DOCUMENTS

| | | |
|---|---|---|
| AU | 410797 | 7/1969 |
| DE | 134151 | 8/1901 |
| DE | 69 36665 | 9/1969 |
| EP | 0 620 355 | 3/1994 |
| EP | 0 609 541 | 8/1994 |
| EP | 0 696 672 | 10/1999 |
| GB | 1093756 | 12/1967 |
| JP | 63-55595 | 11/1984 |
| JP | 63 55595 | 11/1988 |
| JP | 8-210060 | 8/1996 |
| JP | 9-21282 | 1/1997 |
| JP | 11270253 A | 10/1999 |
| WO | WO 98/27307 | 6/1998 |

* cited by examiner

*Primary Examiner*—David Purol
(74) *Attorney, Agent, or Firm*—Camoriano and Associates; Theresa Fritz Camoriano; Guillermo Camoriano

(57) ABSTRACT

A tilter system for a window blind permits a portion of the blind to selectively tilt closed while the balance of the blind remains tilted open. Various arrangements are disclosed for achieving this effect. One includes a lag mechanism in a two-piece tape drum which moves as a single unit during part of its rotation and as two independent drums during the balance of the rotation, with the ladder tape of the blind attached to one of the drums and an actuator cord attached to the other drum. The actuator cord is also anchored to the one of the tilt cables of the ladder tape at a desired point where the selective tilting closed of the blind is to be effected.

32 Claims, 30 Drawing Sheets

SELECTIVE TILTING ARRANGEMENT FOR A BLIND SYSTEM FOR COVERINGS FOR ARCHITECTURAL OPENINGS

This application claims priority from U.S. Provisional application Ser. No. 60/312,570, filed Aug. 15, 2001.

BACKGROUND OF THE INVENTION

The present invention relates to coverings for architectural openings, and, more specifically, to horizontal blinds, such as Venetian blinds, designed to selectively tilt open or tilt closed portions of the blind.

Typically, a Venetian blind has a top head rail or other frame member, which both supports the blind and hides the mechanisms used to raise and lower or open and close the blind. The raising and lowering is done by a lift cord attached to the bottom rail (or bottom slat). The slats, which are supported from the head rail, may be allowed to tilt so as to open the blind to allow a maximum of light through the blind, or to close the blind with the room side down (the edge of the slats which is closest to the room is facing down, which means that the other edge of the slats, the edge which is closest to the window or the wall, will be facing up), or to close the blind with the room side up.

Tilting the blind closed may be done for the purpose of blocking out light, or for obtaining privacy, or both. In order to obtain the optimum performance from the blind, it may be desirable to open one portion of the blind while closing another portion of the blind. For instance, it may be desirable, in an office setting, to tilt closed the lower portion of the blind in order to block the glare of sunlight on a computer screen, or to provide privacy so someone standing outside the window cannot stare through the window and see what is on going on inside the room. However, at the same time, it may be desirable to have the upper portion of the blind tilted open to allow some natural light and/or ventilation into the room. Another instance of an application for such a "split" blind design may be in a home where the floor of the house is at a higher elevation than the ground outside. A person standing in the house could freely see outside, but a person from the outside could not effectively see inside except for the uppermost reaches as allowed by the open section of the blind.

In addition to the issue of privacy and glare elimination, the light control feature of the split blind design is also beneficial in that it minimizes the ultraviolet light deterioration resulting from sunlight impacting on interior furnishings, rugs, hardwood floors, etc. while still maintaining indirect lighting from the outside as well as a clear view of the outside. This is particularly practical and applicable in buildings with a roof overhang over the window area or where the windows are recessed into the wall, creating an overhang.

Japanese Patent Application Number S63-55595 shows a design in which one portion of the blind can be closed while another is open. This reference seems to require at least 450 degrees of rotation of the tilt rod to complete one entire cycle, from one extreme position to the other extreme position of the blinds. There are two sets of tilt cords per tilt station, with the first set of tilt cords attached to a drive drum portion and the second set of tilt cords attached to a driven drum portion. The drive drum must rotate a full 360 degrees before it engages the driven drum, and it must then rotate an additional amount (probably no less than an additional 90 degrees and possibly another 360 degrees) to actuate the second set of tilt cords attached to the driven drum. By then, the first tilt cords are wrapping over themselves onto the drive drum, resulting in a shortening of these tilt cords, which raises the bottom rail away from the window sill, causing an undesirable daylight gap at the bottom of the blind. The overwrapping also may cause a problem with the cords tangling. In addition, the drive drum must rotate a full 360 degrees once it reverses direction before it can engage the driven drum in the opposite direction.

SUMMARY OF THE INVENTION

One objective of the present invention is to provide a blind system, which allows the user to tilt open or tilt closed the entire blind, as well as to selectively tilt open one portion of the blind while another portion of the blind is tilted closed.

The present invention achieves this goal without the need for overwrapping of the cords and without lifting the bottom of the blind to create a light gap between the blind and the window sill.

Various embodiments of the present invention provide a drive drum portion and a driven drum portion, with tilt cables and actuator cords connected to the various drum portions. Since both the tilt cables and the actuator cords serve to actuate the slats of the blind, the terms may be used interchangeably. The embodiments provide various means for effecting a lag between the rotation of the drive drum portion and the driven drum portion. The lag mechanism is similar to a clutch, which engages the driven drum portion to the drive drum portion during part of the rotation of the drive drum portion, and disengages it for the balance of the rotation. In some embodiments, the driven drum portion has extensions, which contact a fixed member (such as the mounting cradle), which serve as limit stops, limiting the rotation of the driven drum portion. The driven drum portion, in turn, limits the extent of rotation of the drive drum portion, which prevents the over wrap condition of the Japanese Patent.

DESCRIPTION OF THE PREFERRED EMBODIMENTS

Figure 1:
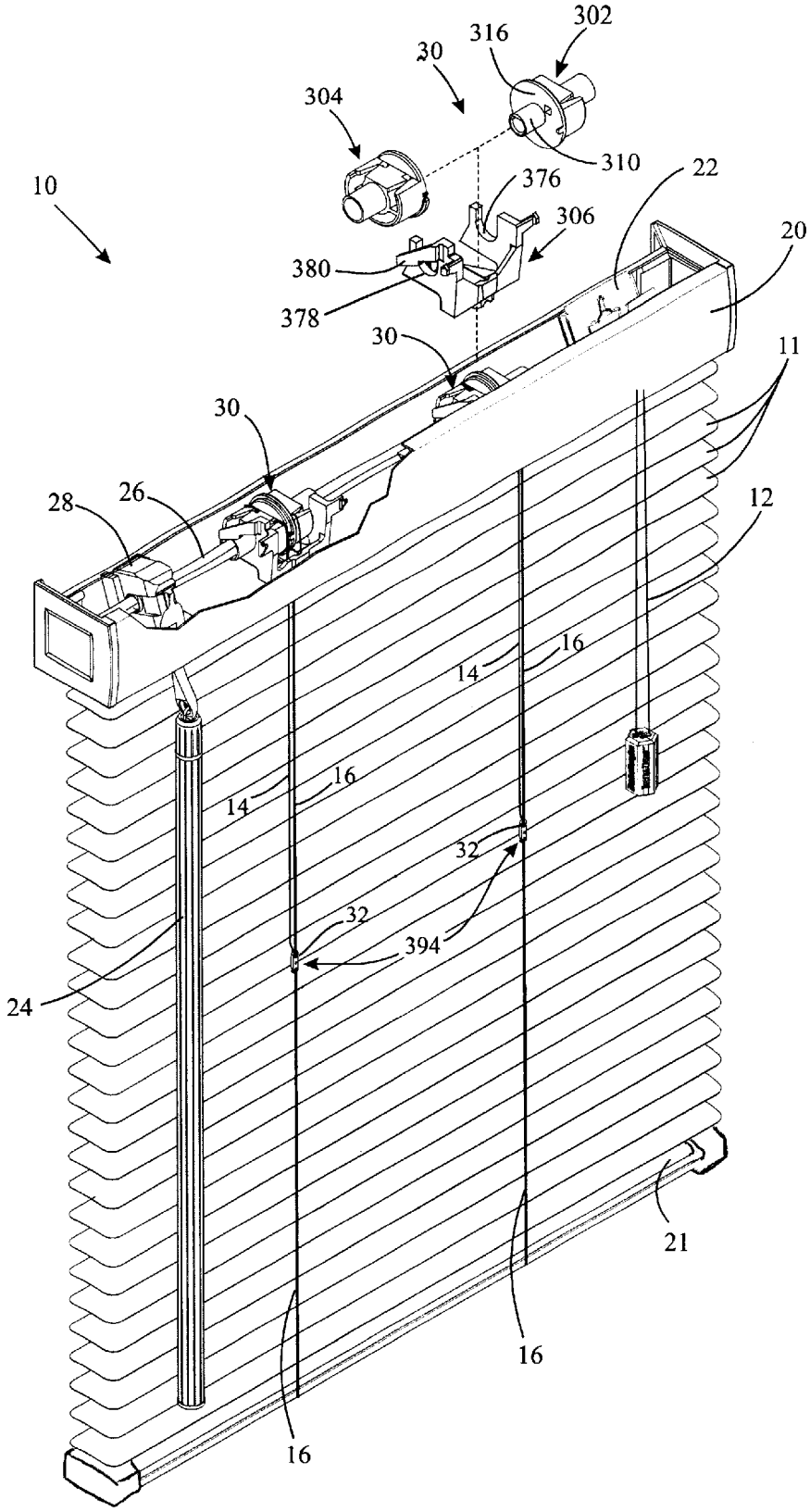
FIG. 1 is a partially broken away, perspective view of a blind system made in accordance with the present invention, with an exploded perspective view of one of the tape drums also shown above the blind.

Referring now to FIG. 1, the blind 10 includes a head rail 20 and a plurality of slats 11 suspended from the head rail 20 by means of tilt cables 16 and their associated cross cords 17 (See FIG. 10A), which together comprise the ladder tapes 18. Lift cords 12 are fastened at the bottom of the bottom slat (or bottom rail) 21, which typically is heavier than the other slats 11. As is well-known in the art, the lift cords 12 are routed through rout holes in the slats 11, through the head rail 20, and out through a cord lock mechanism 22. An operator tilt wand 24 is rotatable about its longitudinal axis to actuate tilt stations 30 via a tilt rod 26 and a tilter 28 as is also well known in the art. However, the tilt stations 30 of the present invention are different from those of the prior art, as will be described shortly. Not normally found in a blind is an actuator cord 14, which runs parallel to the tilt cables 16 and attaches to the ladder tapes 18 via a clip attachment 32, as will be described later. While a wand tilter 24 is shown, it is understood that the tilt rod 26 may be rotated by other means such as a cord tilter or a motorized tilter.

In order to cause certain portions of the blind 10 to open or close independently of the rest of the blind stack, the actuator cord 14 is activated separately from the tilt cables 16. As will be appreciated from the following description, this separate means of activation of the actuator cord 14 may be the result of such actions as pulling separately on the actuator cord 14, attaching the actuator cord or one of the tilt cables 16 to a stationary object (such as the head rail 20), or attaching the actuator cord 14 and the tilt cables 16 to a tape drum 30 which has a built-in lag when it pulls on these cords 14, 16 via such mechanisms as eccentric mounting of the cords 14, 16 and/or by selectively rotating driving and driven drums. In one embodiment, separate ladder tapes are used to control separate portions of the blind, instead of using an actuator cord.

Figure 2A:
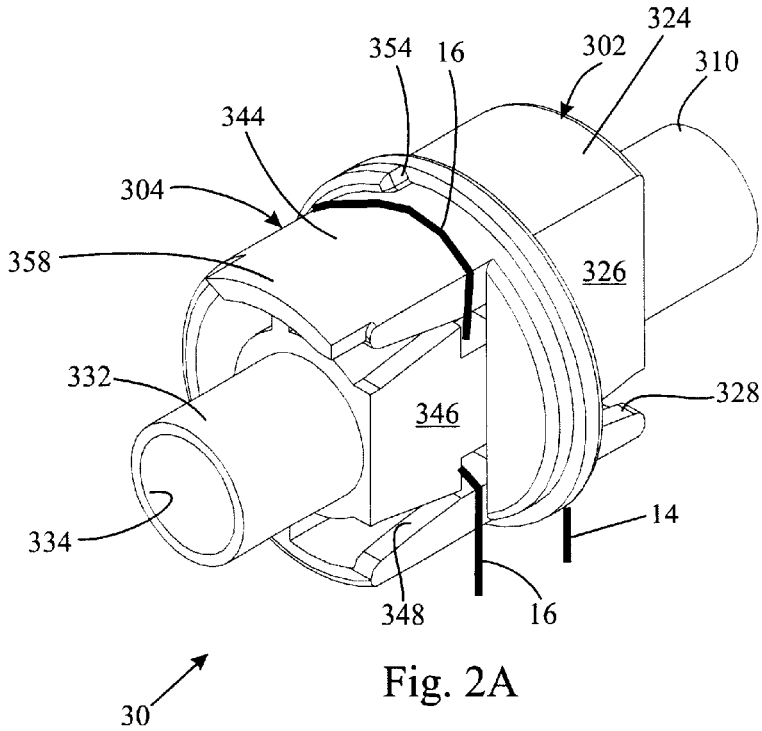
FIG. 2A is a perspective view of one of the tape drums of FIG. 1, showing its position and that of the tilt cables corresponding to the full blind in the tilted closed position as shown in FIG. 2C.
Figure 2B:
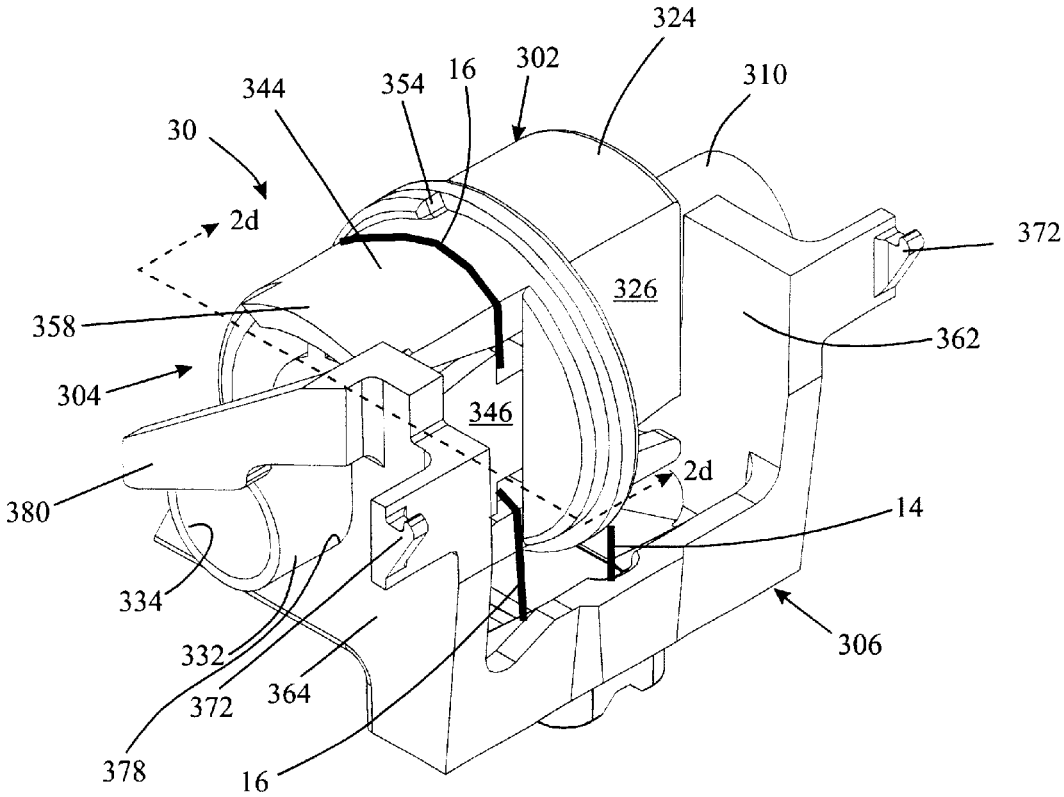
FIG. 2B is the same view as FIG. 2A but with the tape drum mounted on its cradle.

Referring to FIGS. 1, 2A and 2B, the tape drum 30 includes a drive drum portion 302, a driven drum portion 304, and a cradle 306, which houses and rotatably supports the tape drum 30 in the head rail 20.

FIGS. 6A–6D show the drive drum 302, which includes a hollow shaft 310 extending the full length of the drive drum 302, with a non-circular cross-section inside surface 312, which closely matches the cross-sectional profile of the tilt rod 26 such that, when the tilt rod 26 rotates, it drives the drive drum 302 as will be described in more detail later. A circular flange 314 is fixed to the shaft 310 and forms a flat shoulder 316 facing toward the left end 318 of the drive drum 302. Extending from the circumferential edge of the flange 314, a finger 322 projects to the left, and a truncated cylindrical projection 324 projects towards the right end 320 of the drive drum 302. The truncated cylindrical projection 324 is concentric with the hollow shaft 310, and it has a flat 326 which truncates the truncated cylindrical projection 324. The flat 326 defines a slotted opening 328 into an internal cavity 330, used for receiving and securing a tilt cable 16 or actuator cord 14 as will be described later.

FIGS. 5A–5D show the driven drum 304, which has a substantially similar shape to that of the drive drum 302. The driven drum 304 has a hollow shaft 332 extending the full length of the driven drum 304, with a cylindrical internal surface 334, which closely matches the cylindrical outside surface of the hollow shaft 310 extending out the left end 318 of the drive drum 302, so the hollow shaft 310 of the drive drum 302 fits inside of the hollow shaft 332 of the driven drum 304, and the driven drum 304 rides on and is rotatably supported by the left end 318 of the hollow shaft 310 of the drive drum 302. A circular flange 336 on the driven drum 304 forms a flat shoulder 338 at the right end 340 of the driven drum 304. A truncated cylindrical projection 344 projects toward the left end 342 of the driven drum 304. The truncated cylindrical projection 344 is concentric with the hollow shaft 332, and it has a flat 346, which truncates the truncated cylindrical projection 344. The flat 346 has two slotted openings 348 which connect the flat 346 to internal cavities 350, used for receiving and securing the tilt cables 16 or a tilt cable 16 and actuator cord 14 as will be described later. The circumferential edge of the flange 336 has a first driven surface 352 and a second driven surface 354 approximately 180 degrees from the first driven surface 352. These driven surfaces 352, 354, are located so they will be contacted by the finger 322 of the drive drum 302 as the drive drum 302 rotates in order to drive the driven drum 304. A shorter step 356 acts as a "catch" or detent and also provides driven surfaces against which the finger 322 of the drive drum 302 may act to drive the driven drum 304.

Figure 3A:
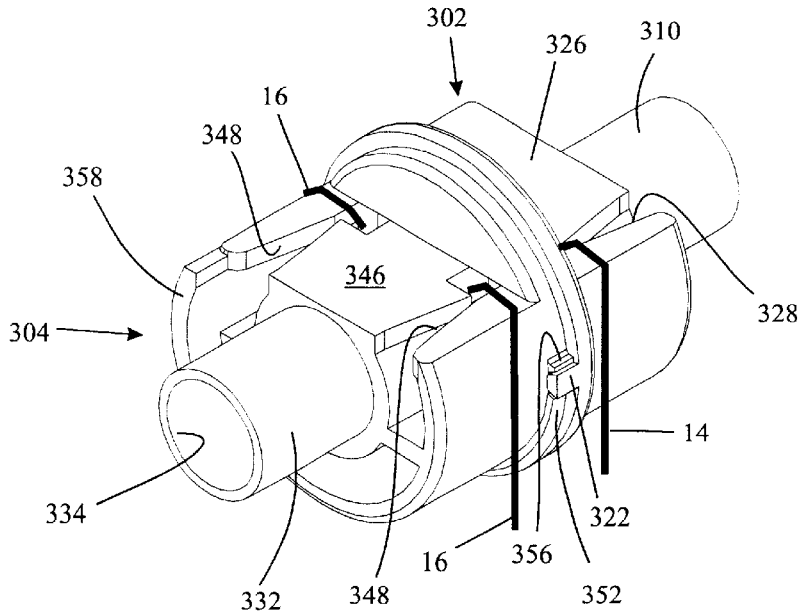
FIG. 3A is a perspective view of the tape drum of FIG. 1, showing its position and that of the tilt cables corresponding to the full blind in the tilted open position as shown in FIG. 3C.

When the drive drum 302 and driven drum 304 are assembled with their respective flat shoulders 316, 338 in direct contact with each other and the left end 318 of the hollow shaft 310 of the drive drum 302 inside the hollow shaft 332 of the driven drum 304, and when the finger 322 of the drive drum 302 is "caught" between the first driven surface 352 and the step or detent 356, the flats 326 and 346 are aligned with each other so as to be coplanar, as shown in FIG. 3A. This position corresponds with the fully open position of the blind, as will be explained later.

On the driven drum 304, a wing (or cradle-impacting member) 358 extends to the left, beyond the truncated cylindrical projection 344, and this wing 358 contacts the cradle 306 and acts as a stop to limit the rotation of the driven drum 304 relative to the cradle 306, as will be described later.

Figure 2C:
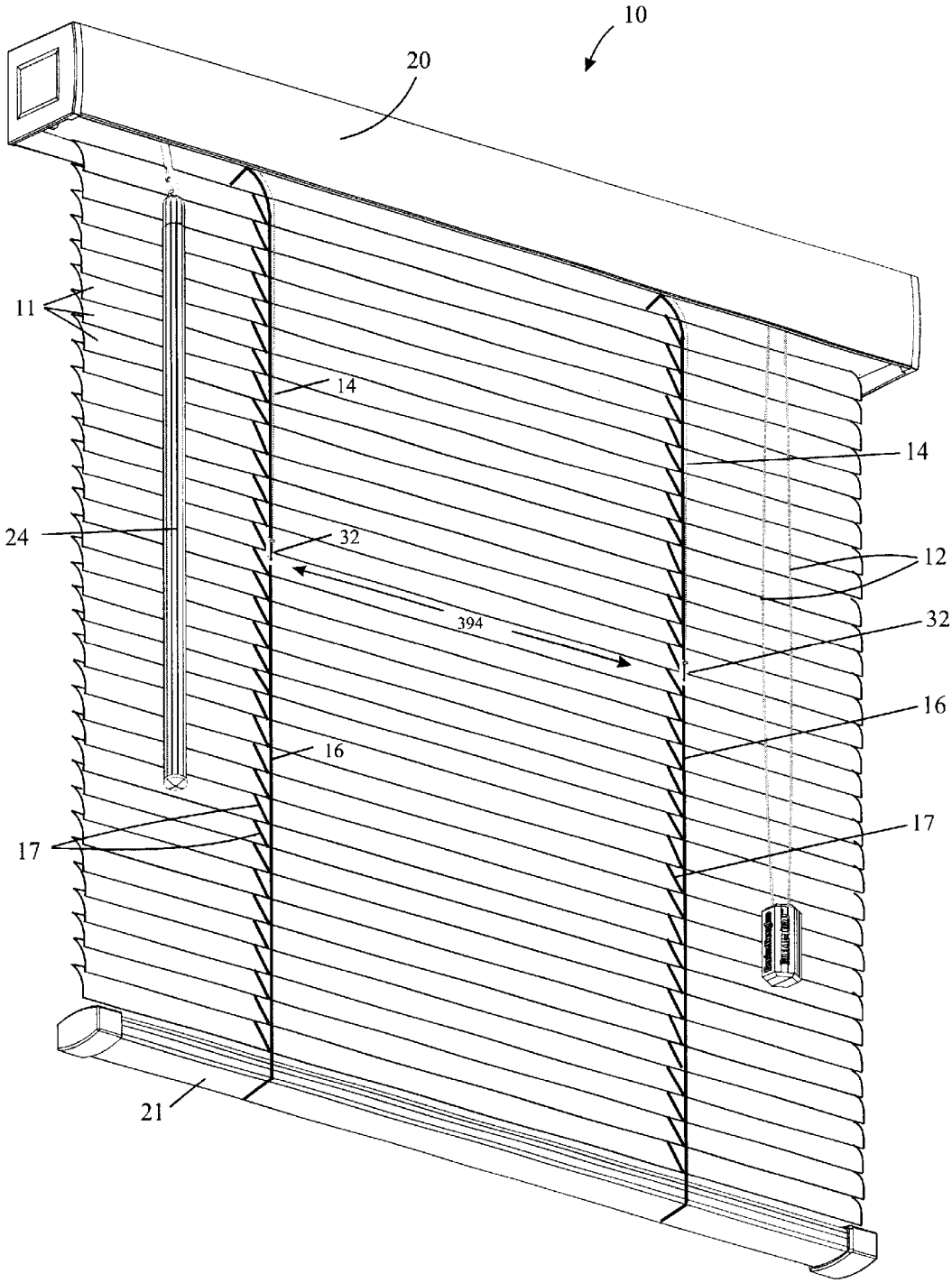
FIG. 2C is a perspective view of the blind system of FIG. 1, when the tape drum is in the position depicted in FIG. 2A.
Figure 2E:
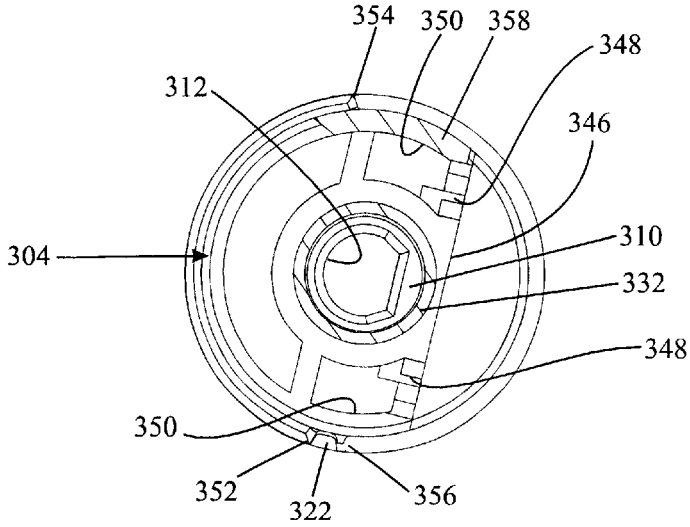
FIG. 2E is the same view as FIG. 2D but with the cradle removed for clarity.
Figure 2D:
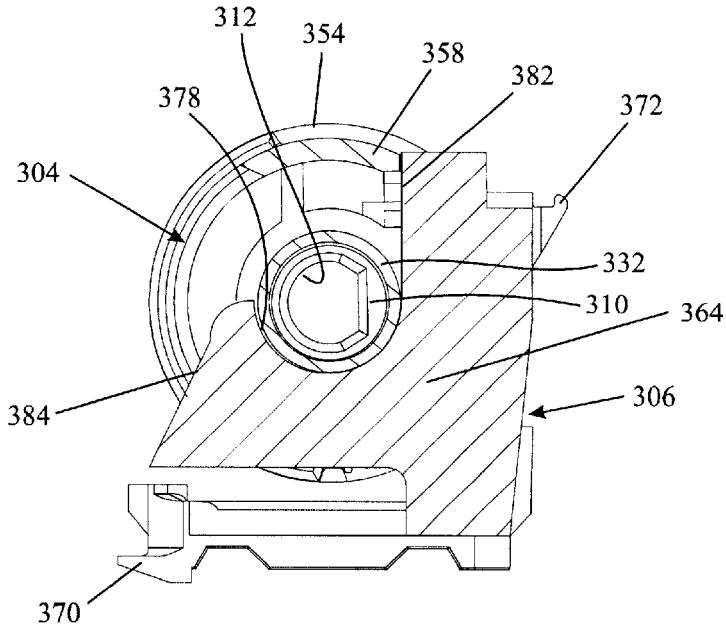
FIG. 2D is a section view along line 2D—2D of FIG. 2B (with the tilt cables removed for clarity)
Figure 3B:
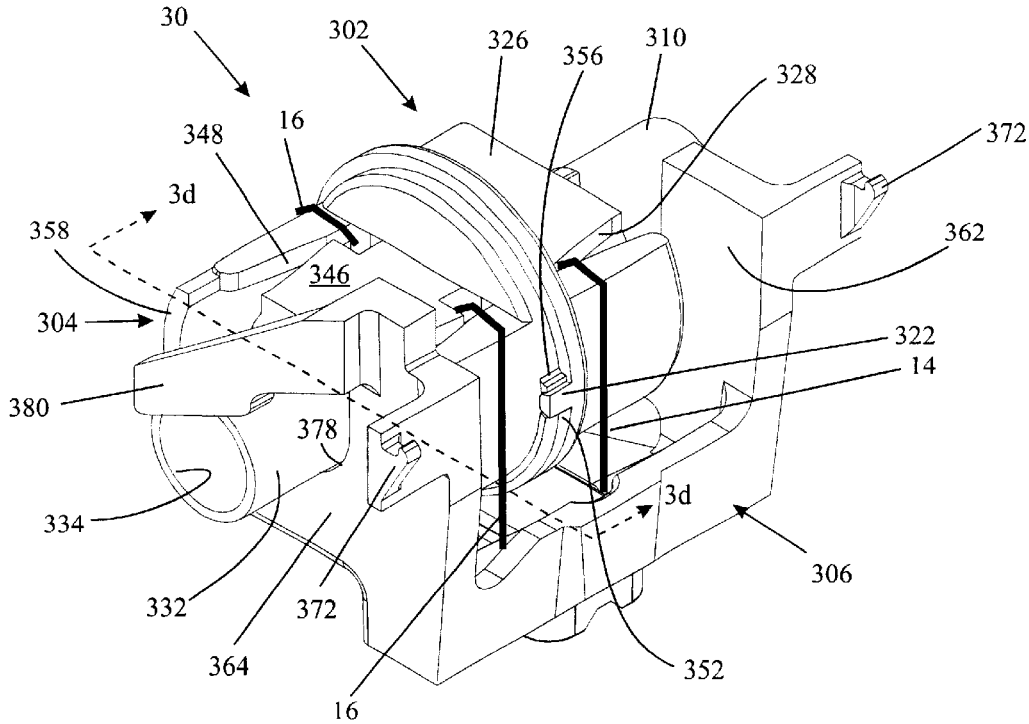
FIG. 3B is the same view as FIG. 3A but with the tape drum mounted on its cradle.
Figure 3C:
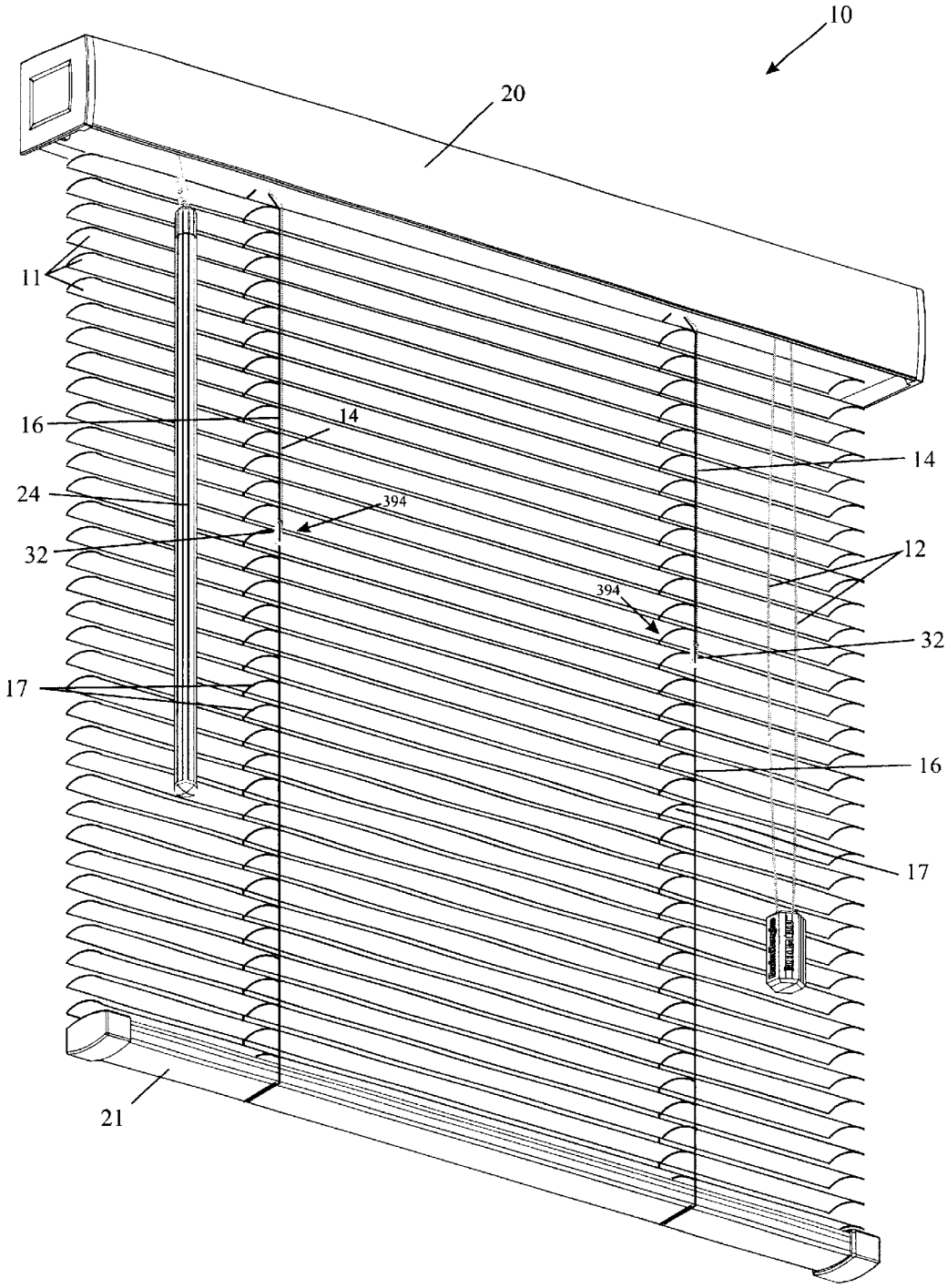
FIG. 3C is a perspective view of the blind system of FIG. 1 in the fully open position, when the tape drum is in the position depicted in FIG. 3A.
Figure 3E:
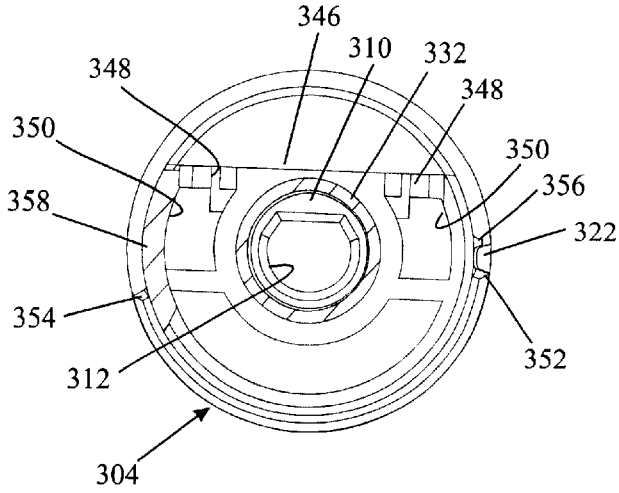
FIG. 3E is the same view as FIG. 3D but with the cradle removed for clarity.
Figure 3D:
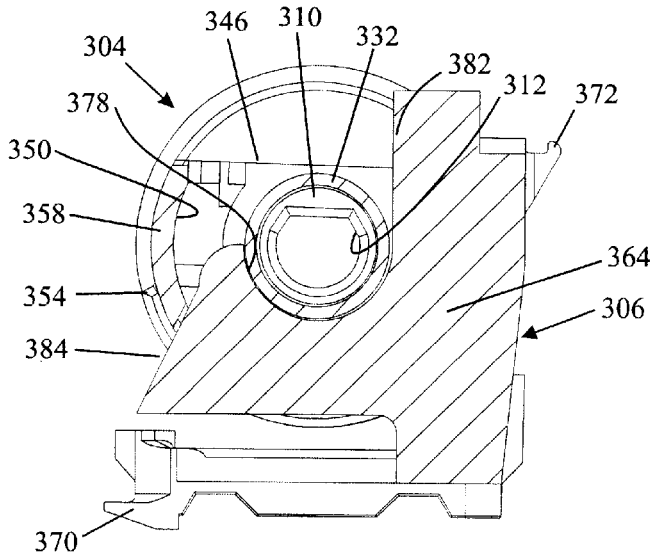
FIG. 3D is a section view along line 3D—3D of FIG. 3B (with the tilt cables removed for clarity)
Figure 7:
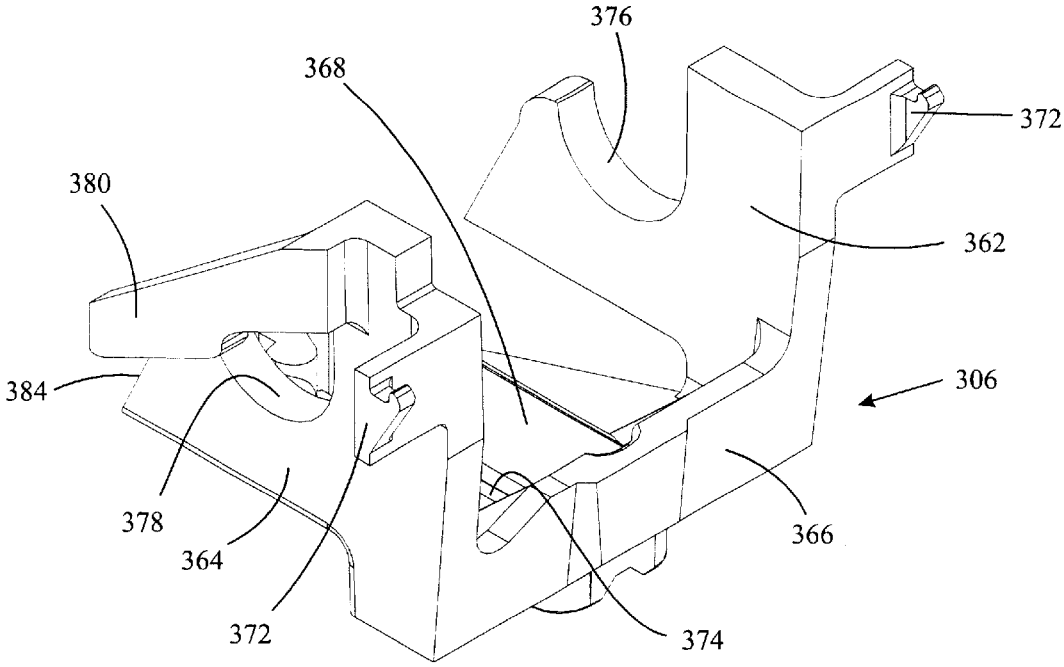
FIG. 7 is a perspective view of the drum cradle of FIG. 1.
Figure 8:
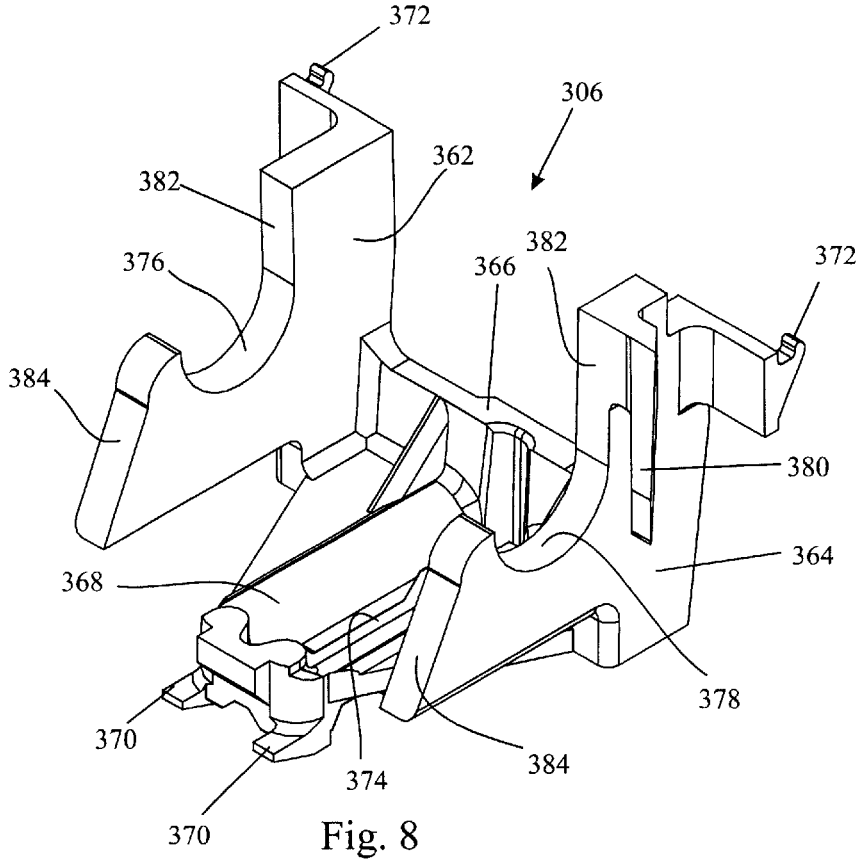
FIG. 8 is an opposite-side perspective view of the drum cradle of FIG. 7.

The cradle 306 (See FIGS. 7 and 8) is a U-shaped bracket, used to mount the tape drum portions 302, 304 for rotation in the head rail of the blind. The cradle 306 has right and left arms 362, 364 connected together by an interconnecting bar 366. Extending from the bar 366 and between the two arms 362, 364 is a foot 368, which ends in two toes 370. There are also two fingers 372 projecting upwardly from the arms 362, 364. These toes 370 and fingers 372 are received in recesses (not shown) in the head rail 20 in order to securely mount the cradle 306 to the inside of the head rail 20. The foot 368 also defines a slotted opening 374, which matches with a similar slotted opening (not shown) in the bottom surface of the head rail 20 to provide a passageway for the ladder tapes 18 and the actuator cord 14 to enter the head rail 20 and reach the tilt station 30. The arms 362, 364 are substantially J-shaped, with the crook 376 of the right arm 362 rotatably supporting the hollow shaft 310 of the drive drum 302, and the crook 378 of the left arm 364 rotatably supporting the hollow shaft 332 of the driven drum 304, as shown in FIG. 2B. A projection 380, extending from the top of the arm 364 and at approximately a 45 degree angle from the left planar surface defined by the arm 364, partially encloses the top of the hollow shaft 332 of the driven drum 304, releasably securing the tape drum assembly 302, 304 to the cradle 306 while allowing rotation of the tape drum about its longitudinal axis (which coincides with the longitudinal axis of the tilt rod 26, which is inserted through the mated hollow shafts 310, 332 of the drive and driven drums 302, 304 respectively). This is seen best in FIG. 2B. As seen from the left end of the blind, the long leg 382 of the J-shaped left arm 364 provides a limit stop to the clockwise rotation of the driven drum 304 as the wing 358 on the driven drum 304 impacts against this long leg 382 as shown in FIGS. 2B and 2D. The short leg 384 of the J-shaped left arm 364 provides a limit stop to the counter-clockwise rotation of the driven drum 304 as the wing 358 on the driven drum 304 impacts against this short leg 384 as shown in FIGS. 3B and 3D. Thus, the driven drum 304 is restricted to rotation only along a pre-selected angular displacement (approximately a 90 degree angle in the present embodiment) before one or the other of the legs 382, 384 of the cradle's left arm 364 stops the rotation when it is contacted by the cradle-impacting member (or wing) 358 of the driven drum 304.

Of course, while the wing 358 of this embodiment is made as a single member, extending along a defined rotational angle of the driven drum 304 and having two cradle-impacting surfaces, it could just as well be two separate members, each with its own cradle-impacting surface.

Figure 9A:
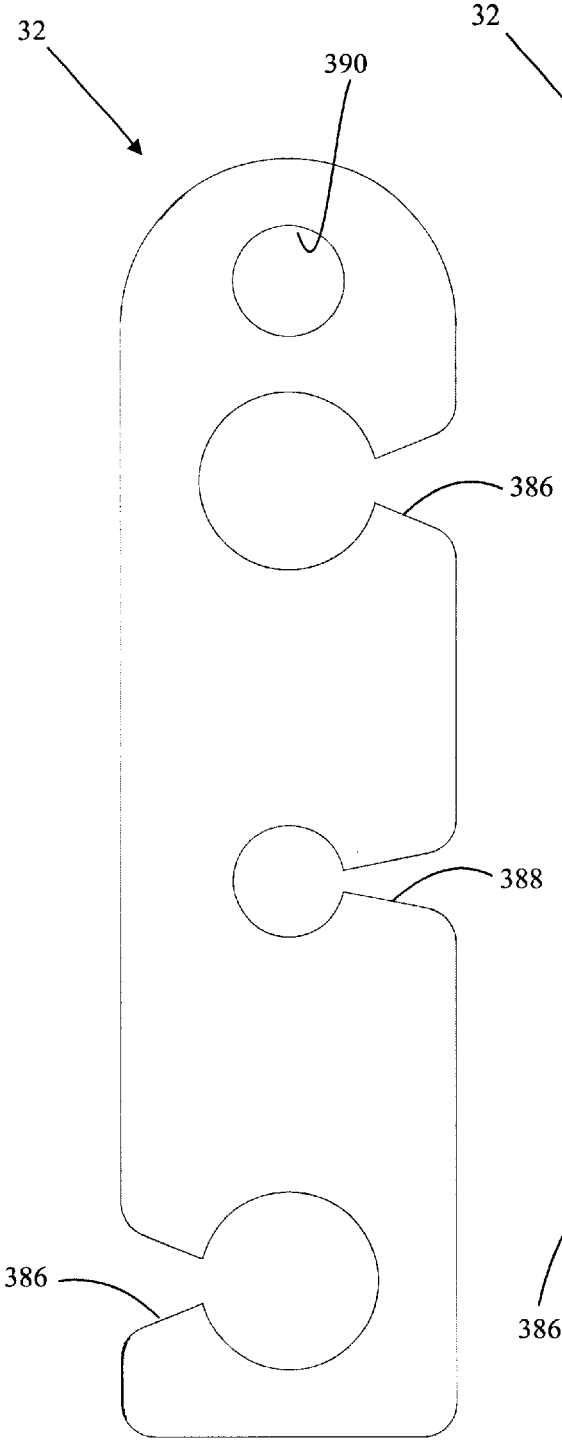
FIG. 9A is a side view of the cord-to-tape attachment clip shown in FIG. 1.
Figure 9B:
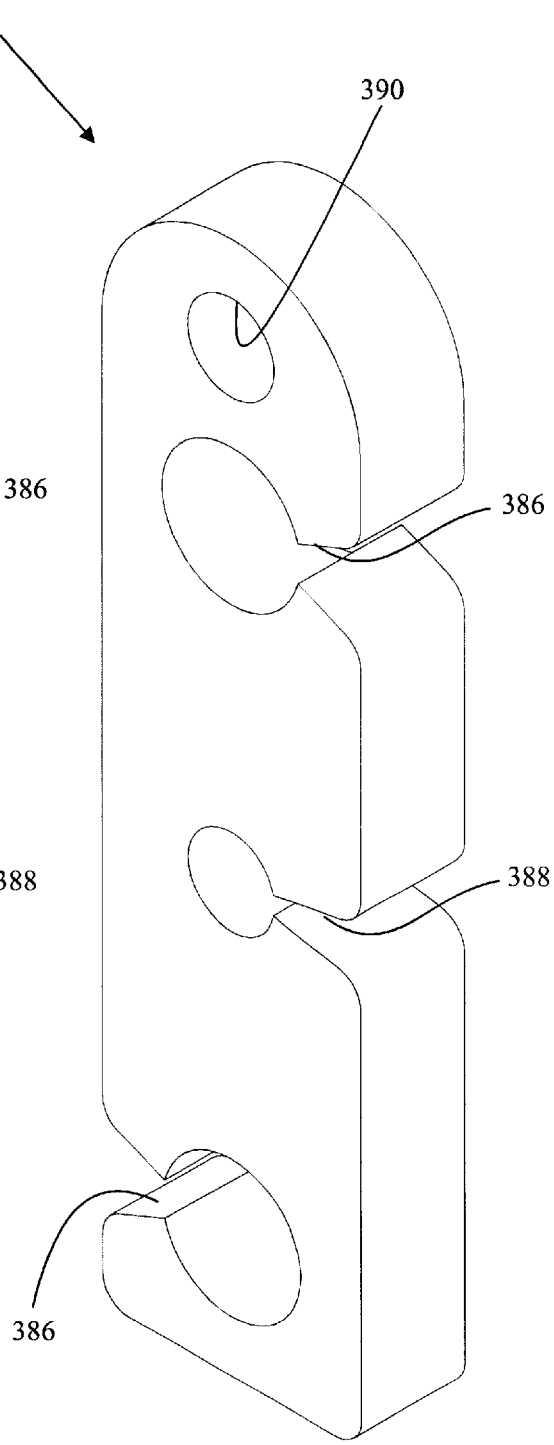
FIG. 9B is a perspective view of the cord-to-tape attachment clip of FIG. 9A.
Figure 10A:
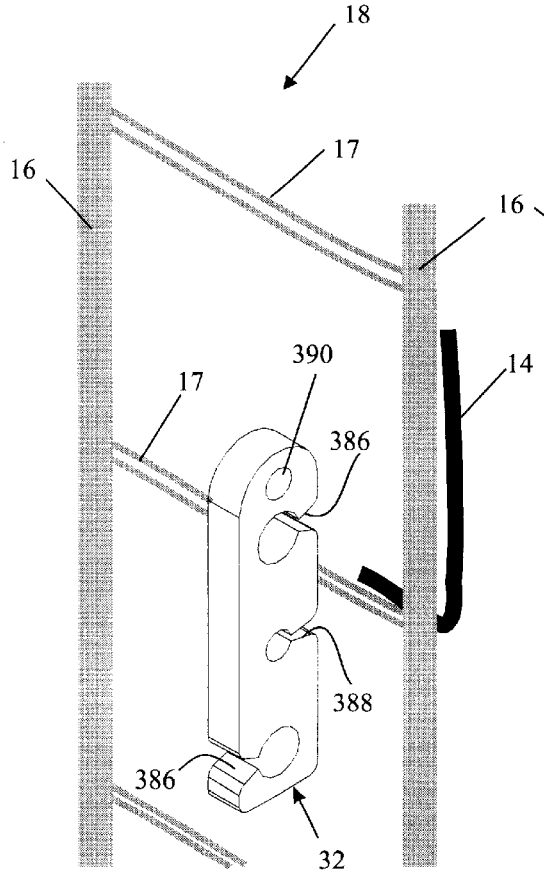
FIG. 10A is a perspective schematic depicting the first step in attaching the cord to the tape using the cord-to-tape attachment clip of FIG. 9B.
Figure 10B:
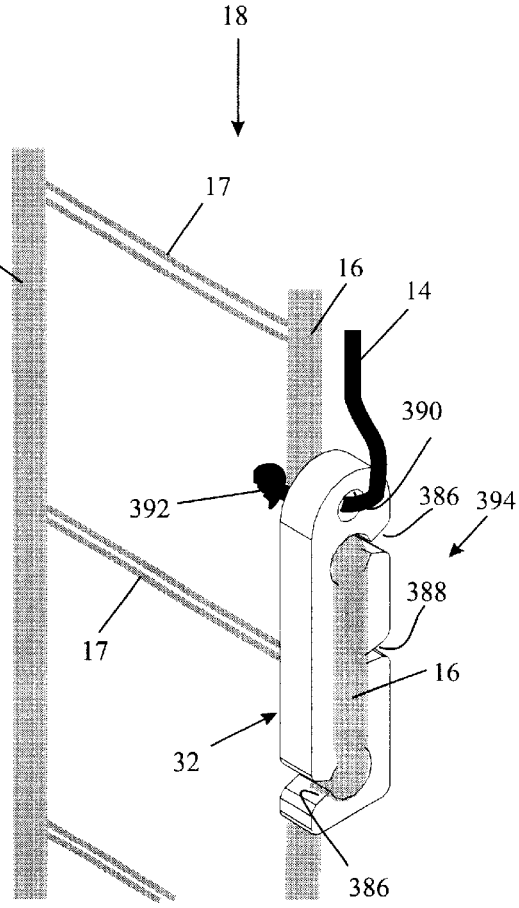
FIG. 10B is the same schematic as in FIG. 10A but showing the cord-to-tape attachment clip already installed.
Figure 11A:
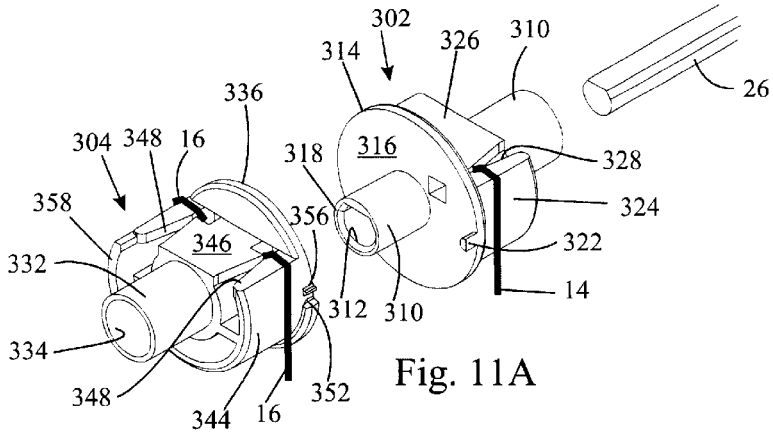
FIG. 11A is an exploded, perspective view of the drive drum portion and driven drum portion, the tilt rod, the tilt tapes and the tilt cord (or actuator cord) of FIG. 1.
Figure 11B:
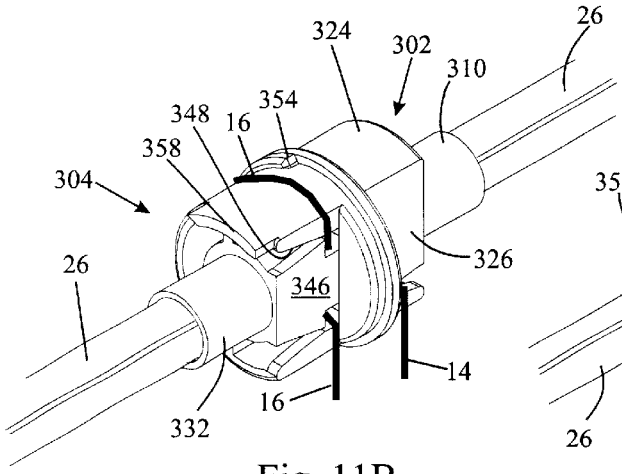
FIG. 11B is a perspective view of the assembled components from FIG. 11A, shown in the position corresponding to the fully closed blind as shown in FIG. 12A.
Figure 11C:
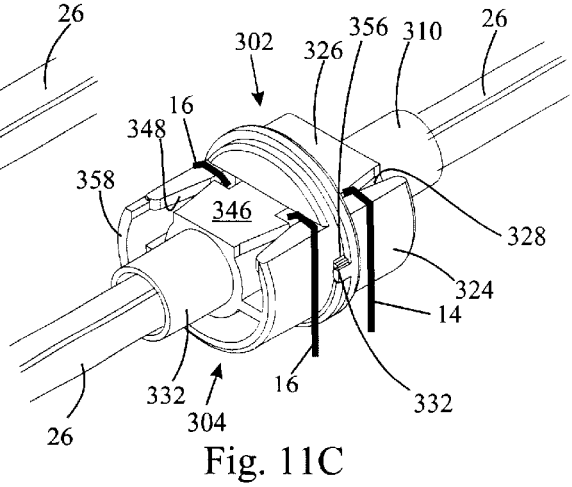
FIG. 11C is the same view as FIG. 11B except that the position corresponds to the fully open blind as shown in FIG. 12B.
Figure 11D:
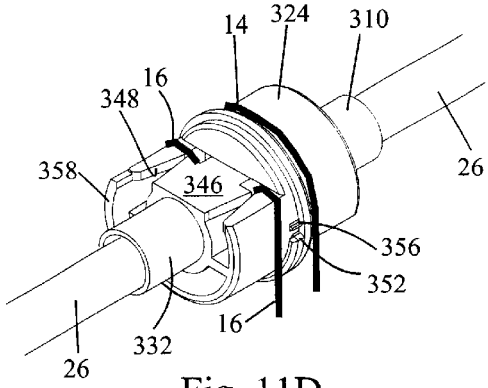
FIG. 11D is the same view as FIG. 11B except that the position corresponds to the lower portion of the blind being fully closed while the upper portion of the blind is fully open, as shown in FIG. 12C.

FIGS. 9A and 9B show the cord-to-tape attachment clip 32, which is used to attach the actuator cord 14 to the tilt cable 16 of the ladder tape 18, as shown in FIGS. 10A and 10B. The flat, substantially rectangular clip 32 defines upper and lower large slotted openings 386, which open to the right and left sides of the clip 32, respectively, a smaller slotted opening 388 in between the two larger openings 386 and opening to the right, and a fourth opening 390 at the upper end of the clip 32. FIGS. 10A and 10B demonstrate how the clip 32 is mounted onto the ladder tape 18, and how the actuator cord 14 is secured to the clip 32. One of the tilt cables 16 of the ladder tape 18 is laced through the upper and lower large slotted openings 386 of the clip 32, with a cross cord 17 received in the smaller slotted opening 388. This secures the clip 32 to the ladder tape 18. The end of the actuator cord 14 is fed through the fourth opening 390, and a knot 392 is then tied at the end of the actuator cord 14 so that the cord 14 cannot pull back out of the hole 390. Now, as the actuator cord 14 is pulled up, it also pulls the clip 32 and the lower portion of the tilt cable 16 to which the clip 32 is securely attached.

Assembly of the Tilt Station 30

In order to assemble the tilt station 30 of the present invention, the drive drum 302 and the driven drum 304 are assembled by inserting the hollow shaft 310 of the drive drum 302 into the hollow shaft 332 of the driven drum 304 so that the flat shoulders 316, 338 of the drive and driven drums 302, 304 are pressed together, the shafts 310 and 332 are mated together, and the finger 322 of the drive drum 302 is caught between the first driven surface 352 and the step 356 on the flange 336 of the driven drum 304. The tape drum assembly 302, 304 is then inserted into the cradle 306 such that the leftwardly-projecting portion of the hollow shaft 332 of the driven drum 304 lies on the crook 378 of the left arm 364 of the cradle 306, and the rightwardly-projecting portion of the hollow shaft 310 of the drive drum 302 lies on the crook 376 of the right arm 362 of the cradle 306. The tilt rod 26 is then inserted through the mated hollow shafts 310, 332 of the drive and driven drum 302, 304 respectively. The cradle 306 is then snapped onto the head rail 20, with the slotted opening 374 of the cradle 306 lining up with the matching slotted opening in the head rail 20 so that the tilt cables 16 and the actuator cord 14 may pass from the outside of the blind 10 to the inside of the head rail 20 and may then be attached to the tilt station 30 as described below.

Figure 4A:
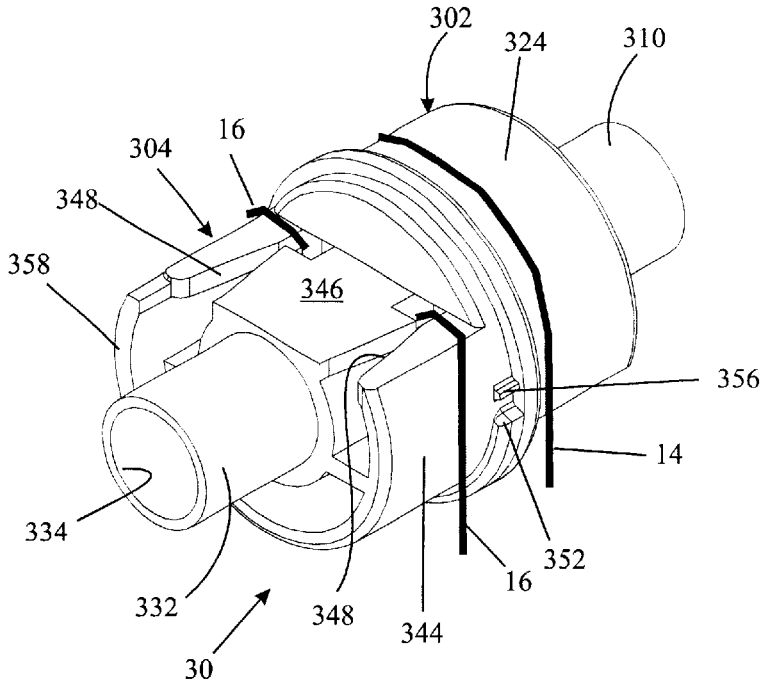
FIG. 4A is a perspective view of the tape drum of FIG. 1, showing its position and that of the tilt cables corresponding to the lower part of the blind being in the tilted closed position, and the balance of the blind being in the tilted open position as shown in FIG. 4C.
Figure 4B:
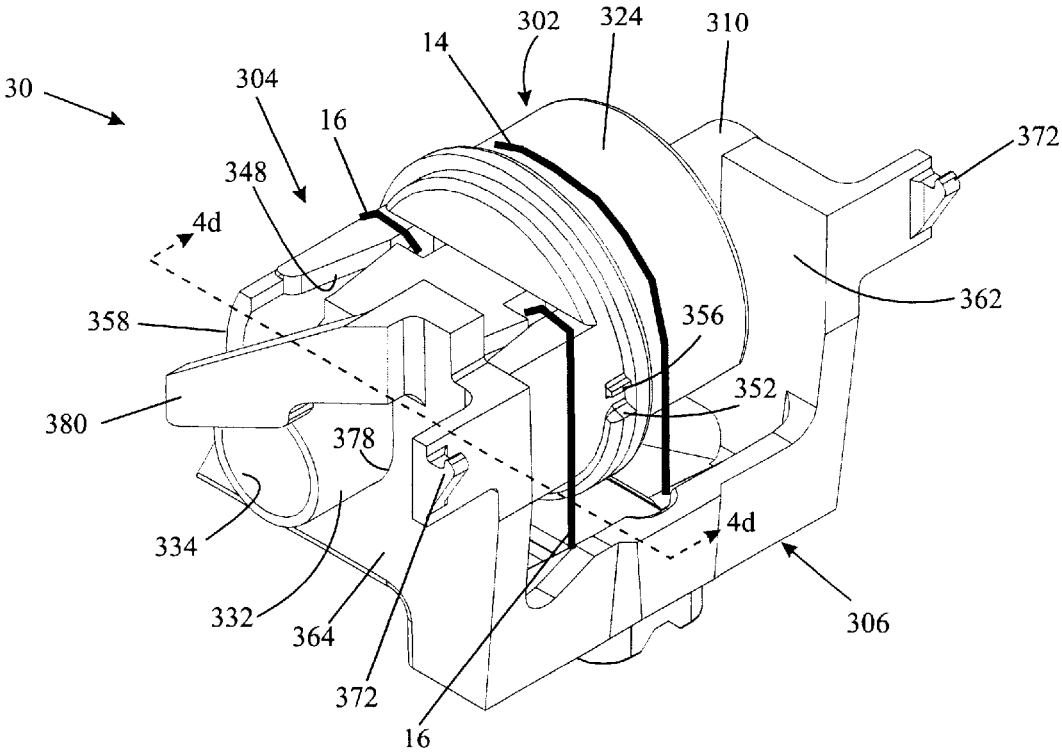
FIG. 4B is the same view as FIG. 4A but with the tape drum mounted on its cradle.

There is one tilt station 30 for each ladder tape 18. The two tilt cables 16 of the ladder tape 18 are fed through the slotted opening 374-of the cradle 306, knots or grommets are secured to the ends of the tilt cables 16, and these ends are slid behind the slotted openings 348 of the driven drum 304 into the chambers 350, such that the tilt cables 16 are secured to the driven drum 304, with one of the tilt cables 16 lying on either side of the hollow shaft 332 of the driven drum 304, as shown in FIGS. 4B and 12B. The actuator cord 14 is similarly fed through the slotted opening 374 of the cradle 306, and a knot or grommet is tied to its free end, which is then slid behind the slotted opening 328 of the drive drum 302 into the chamber 330, so that the actuator cord 14 is secured to the drive drum 302 as shown in FIG. 3B. The clip 32 is attached to the front tilt cable 16, as has already been described and depicted in FIGS. 10A and 10B, at the desired location, defining the "break" point 394, between the separately-operated portions of the blind 10. The other end of the actuator cord 14 is secured to the clip 32 by passing the actuator cord 14 through the hole 390 of the clip 32 and tying a knot on the end of the cord 14, as has already been described.

Operation of the Tilt Station

Now, as the tilt wand 24 (or other actuator) is rotated fully in one direction, causing the tilt rod 26 to rotate clockwise (as seen from the left side of the blind of FIG. 1), the tilt rod 26 drives the drive drum portion 302 by means of its non-circular cross-section outer surface contacting the non-circular cross-section inner surface 312 of the hollow shaft 310 of the drive drum 302. This Provides a non-slip positive engagement drive between the tilt rod 26 and the drive drum portion 302. A driving surface of the leftwardly-projecting finger 322 on the drive drum 302 contacts the driven surface 352 on the driven drum 304, providing a non-slip Positive engagement drive between the drive drum portion 302 and the driven drum portion 304, causing the driven drum 304 to rotate in the clockwise direction. At this point, the drive drum 302 and driven drum 304 are rotating together in a clockwise direction.

Figure 12A:
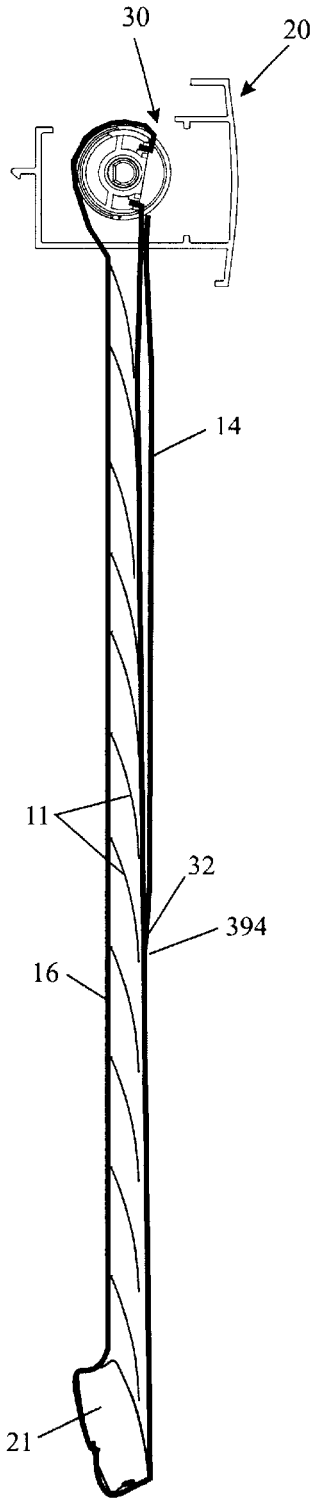
FIG. 12A is a schematic cross-sectional view of the blind of FIG. 2C (with the tilt station cradle removed for clarity), when the blind is in the fully closed position.
Figure 12B:
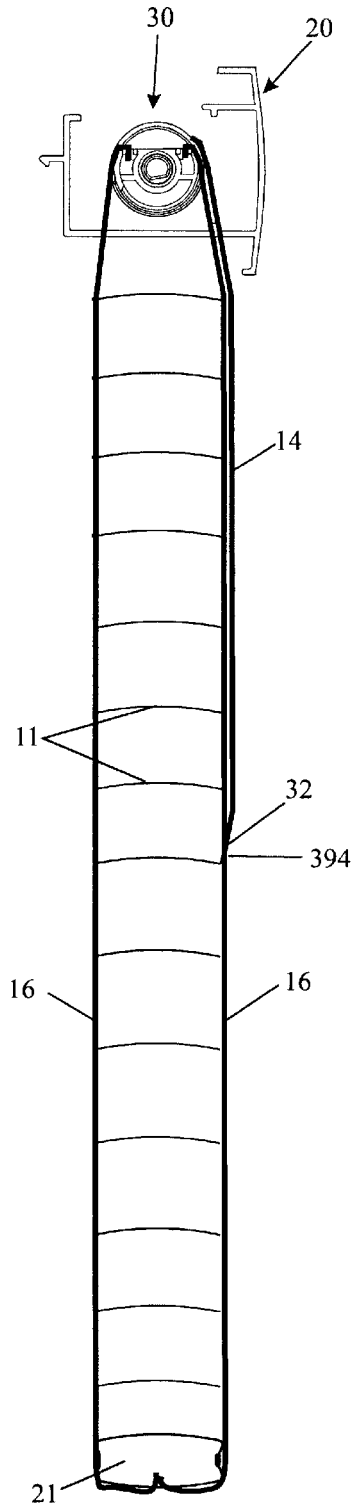
FIG. 12B is a schematic cross-sectional view of the blind of FIG. 3C (with the tilt station cradle removed for clarity), when the blind is in the fully open position.

During this time, all the slats of the blind are tilting together as shown schematically in FIG. 12A. This continues until the wing 358 of the driven drum 304 contacts the long leg 382 of the left arm 364 of the cradle 306, stopping the clockwise rotation of the driven drum 304. Since the finger 322 on the drive drum 302 remains in contact with the driven surface 352 of the driven drum 304 and cannot rotate any further beyond that stopped driven surface 352, the rotation of the drive drum 302 is also stopped. This clockwise-most stopped position is shown in FIGS. 2A, 2B, 2D, 2E, 11B and 12A and corresponds to the position in which the blind 10 is tilted fully closed, room side down, as shown in FIGS. 2C and 12A.

As the tilt wand 24 is rotated in the opposite direction, the tilt rod 26 turns counter-clockwise, causing the drive drum portion 304 also to rotate counter-clockwise. The finger 322 on the drive drum portion 304 then engages the surface of the detent (or step) 356 on the driven drum portion 304, thereby providing a non-slip positive engagement between the drive drum portion 302 and the driven drum portion 304, driving the driven drum portion 304 in the counter-clockwise direction. The drum portions 302, 304 continue to rotate together in the counter-clockwise direction until the driven drum portion 304 is stopped, when the wing 358 on the driven drum portion 304 contacts the short leg 384 of the left arm 364 of the cradle 306 (See FIG. 3D). At this point, the tape drum assembly 302, 304 has rotated approximately 90 degrees from the closed position shown in FIG. 12*a*, and the blind is now in the fully open position, with the drum portions in the position shown in FIGS. 3A, 3B, 3D, 3E, 11C, and 12B. The rear tilt cable 16 has dropped slightly and has unwound from its partially wrapped condition around the truncated cylindrical projection 344 of the driven drum 304, while the front tilt cable 16 and the actuator cord 14 have been raised slightly, resulting in the entire blind 10 being in the fully open position as shown in FIGS. 3C and 12B.

Figure 4C:
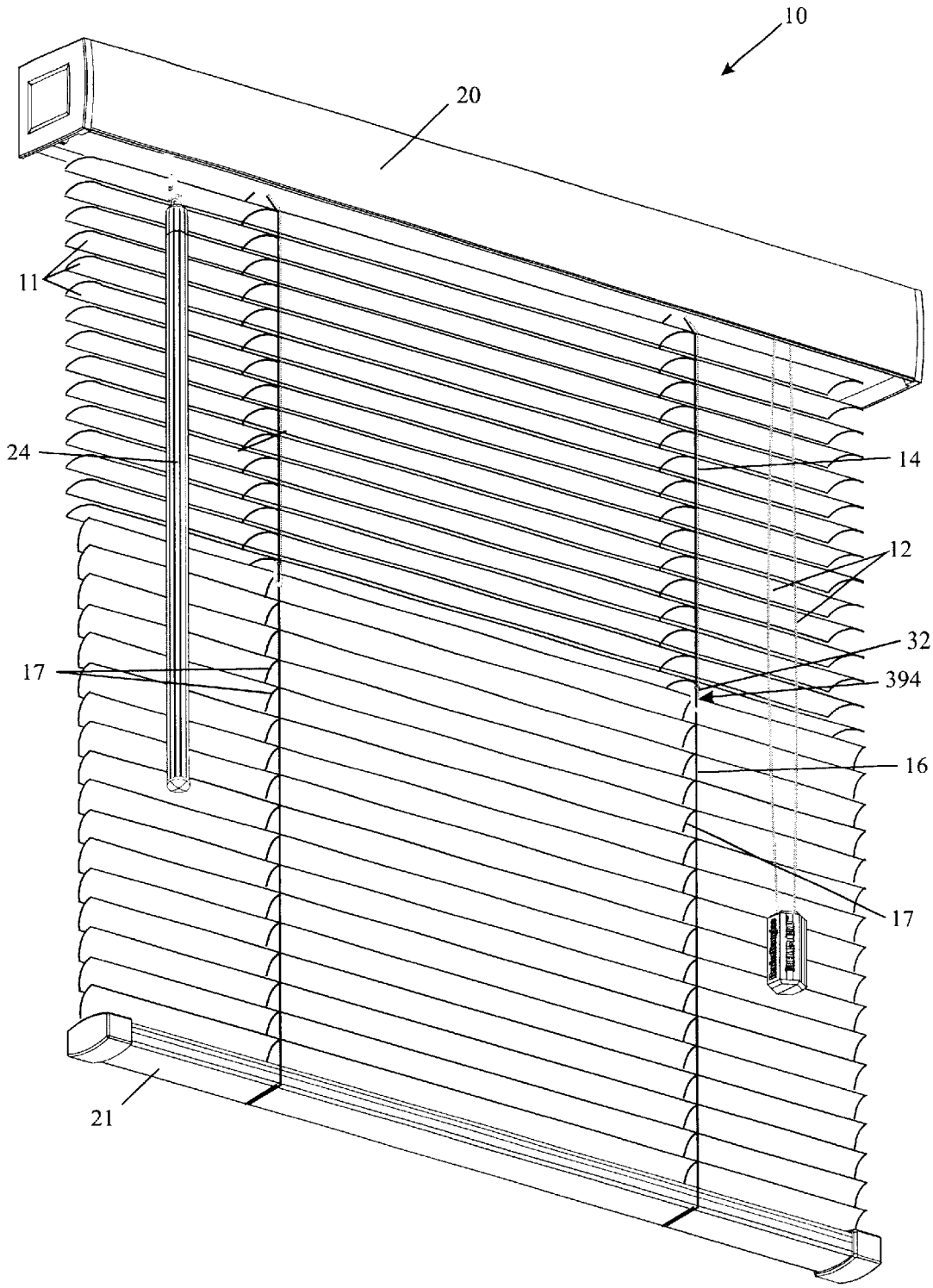
FIG. 4C is a perspective view of the blind system of FIG. 1 with the lower part closed and the upper part open, when the tape drum is in the position depicted in FIG. 4A.
Figure 4E:
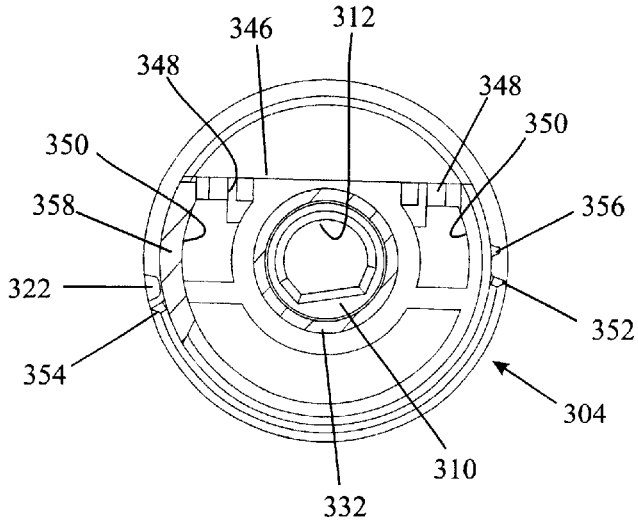
FIG. 4E is the same view as FIG. 4D but with the cradle removed for clarity.
Figure 4D:
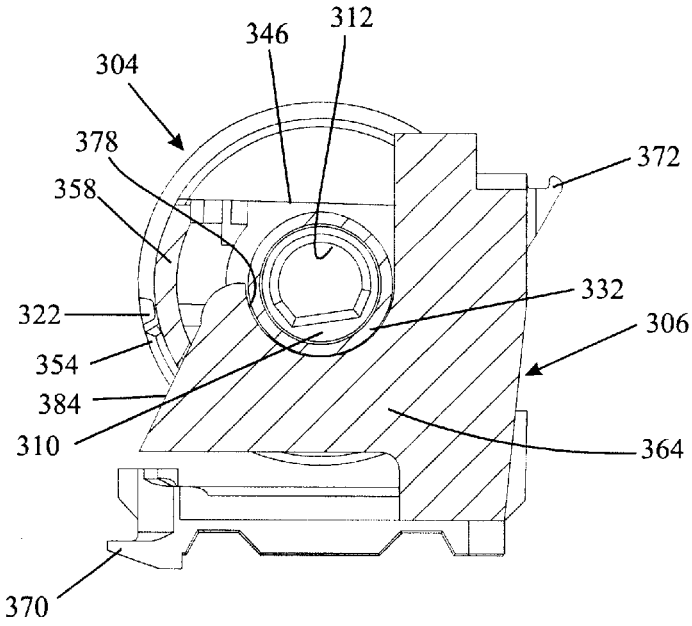
FIG. 4D is a section view along line 4D—4D of FIG. 4B (with the tilt cables removed for clarity)
Figure 5A:
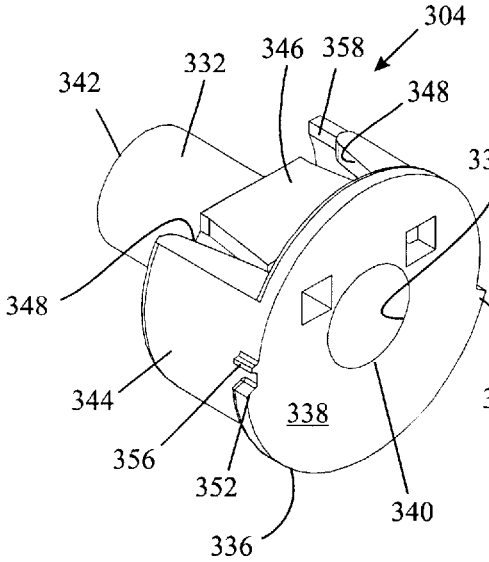
FIG. 5A is a perspective view of the driven drum portion (the left half) of the drum of FIG. 1.
Figure 5B:
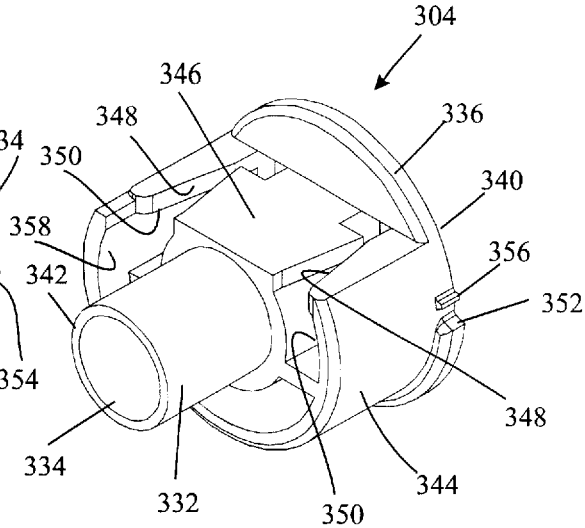
FIG. 5B is an opposite-end perspective view of the driven drum portion of FIG. 5A.
Figure 5C:
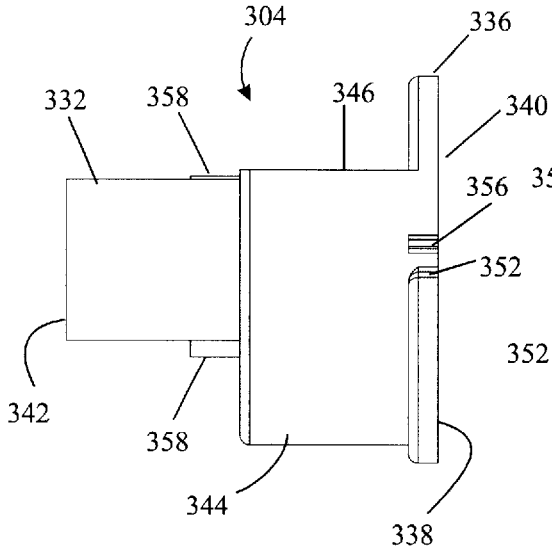
FIG. 5C is a side view of the driven drum of FIG. 5A.
Figure 5D:
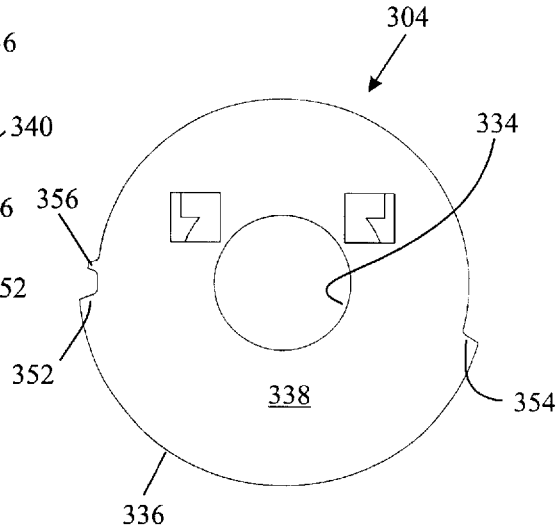
FIG. 5D is an end view of the driven drum of FIG. 5A.
Figure 6A:
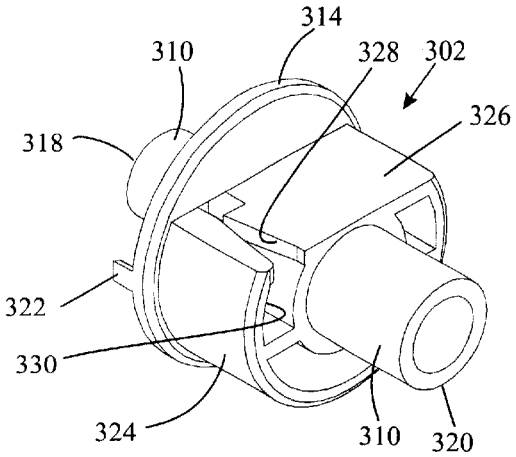
FIG. 6A is a perspective view of the drive drum portion (the right half) of the drum shown in FIG. 1.
Figure 6B:
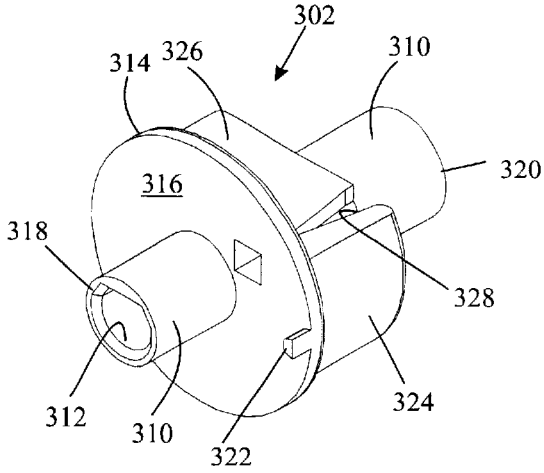
FIG. 6B is an opposite-end perspective view of the drive drum of FIG. 6A.
Figure 6C:
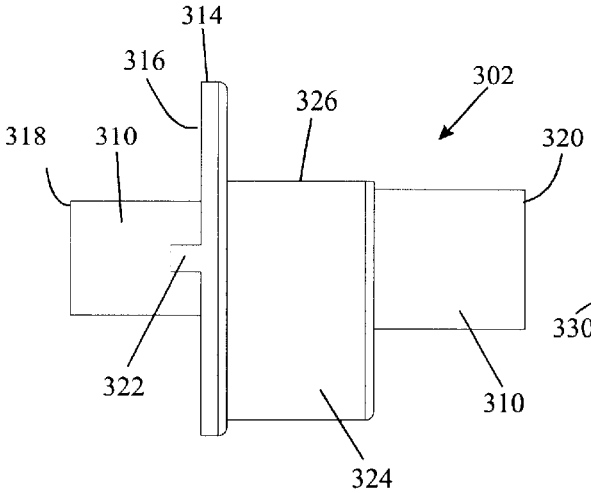
FIG. 6C is a side view of the drive drum of FIG. 6A.
Figure 6D:
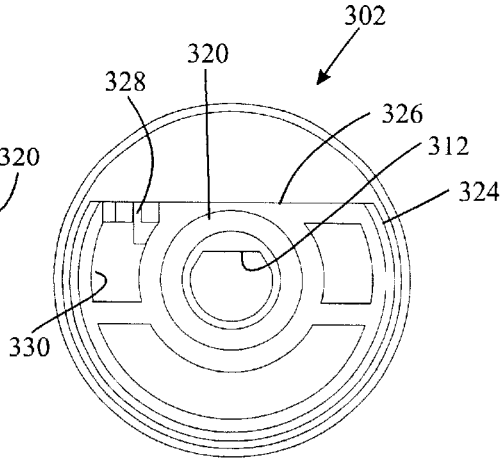
FIG. 6D is an end view of the drive drum of FIG. 6A.

As the tilt wand 24 continues to be rotated in the counter-clockwise direction, the tilt rod 26 continues to turn counter-clockwise, driving the drive drum 302 in the same counter-clockwise direction (See FIGS. 4D and 4E). Since the driven drum 304 cannot rotate any further in the counter-clockwise direction (due to the limit stop caused by the contact of the wing 358 against the short leg 384 of the left arm 364 of the cradle 306), the finger 322 on the drive drum 302 skips over the detent 356 on the driven drum 304, so that only the drive drum 302 continues to rotate for an additional pre-selected angular displacement (approximately 180 degrees in the present embodiment) until the finger 322 contacts the second driven surface 354 on the driven drum 304. Since the driven drum 304 is stopped from further counter-clockwise rotation at this point, contact between the finger 322 of the drive drum and the second driven surface 354 of the driven drum also stops the drive drum 302, thereby defining the counterclockwise-most position of the drive drum 302.

Figure 12C:
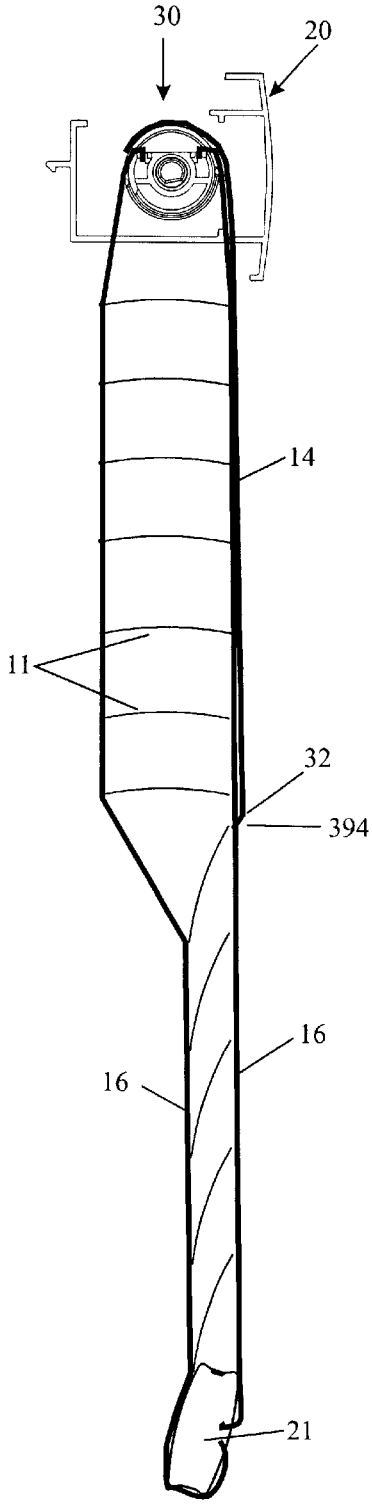
FIG. 12C is a schematic cross-sectional view of the blind of FIG. 4C (with the tilt station cradle removed for clarity), when the upper portion of the blind is in the fully open position, and the lower portion of the blind is in the fully closed position.

At this point, the actuator cord 14 has lifted the lower portion of the front tilt cable 16, thereby closing the bottom portion of the blind in the room-side up position while leaving the top portion open, as shown in FIG. 12C. This condition is illustrated in FIGS. 4A, 4B, 4D, 4E, 11D, and 12C. Since the driven drum 304 has not rotated any further, the tilt cables 16, which are attached to the driven drum 304, have not moved. However, the drive drum 302 has continued to rotate an additional 180 degrees, and this has wrapped the actuator cord 14 around the truncated cylindrical projection 324 of the drive drum 302, pulling up on the clip 32, and thus also pulling up on the front tilt cable 16 at the "break" point 394, where the clip 32 is attached to the tilt cable 16. As the front tilt cable 16 below the break point 394 is raised and the rear tilt cable 16 remains unaffected, the slats 11 below the break point 394 are tilted up to give the effect of a tilted closed blind, room side up, as shown in FIGS. 4C and 12C.

Reversing the direction of rotation of the tilt wand 24 merely reverses the events described above. Namely, when starting from the position depicted by FIG. 12C, as the tilt wand 24 is rotated, causing the tilt rod to rotate clockwise, the weight of the blind 10 on the tilt cables 16 prevents the driven drum 304 from rotating at first, until the drive drum 302 has rotated clockwise approximately 180 degrees lowering the actuator cord, and returning the blind to the open position shown in FIG. 12B. Further rotation of the tilt wand results in the finger 322 contacting a surface of the detent 356 on the driven drum 304, thus Positively driving both drum portions 302, 304 clockwise until the condition depicted in FIG. 12A is reached, where the wing 258 contacts the longer leg 382 of the left arm 364 of the cradle 306, stopping the clockwise rotation of the driven drum portion 304. Further rotation of the tilt wand 24 causes the finger 322 to skip over the detent 356 and forces the finger 322 against the first driven surface 352, which brings the rotation of the entire tilt station 30 to a stop.

Alternate Embodiments

For ease in description, alternate embodiments of mechanisms for selectively tilting portions of a blind will be described by comparing and contrasting them with the first embodiment previously described and schematically illustrated in FIGS. 12A, 12B, and 12C. The cradle 306 has been deleted from all views, but it is understood that the cradle 306 would be present and would be providing the support for rotation and the limit stops, as required, when so indicated. In order to obtain further clarity and brevity in the description, all figures henceforth (where applicable) refer to front tilt cables 16*a* and rear tilt cables 16*b*, front actuator cables 14*a* and rear actuator cables 14*b*, and upper ladder tapes 18*a* and lower ladder tapes 18*b*, where front refers to the room side of the blind 10 and back refers to the window or wall side of the blind 10. (Of course, the directions front, back, left, right, etc. could be reversed in any embodiment without changing the functioning of the blind.)

Figure 13A:
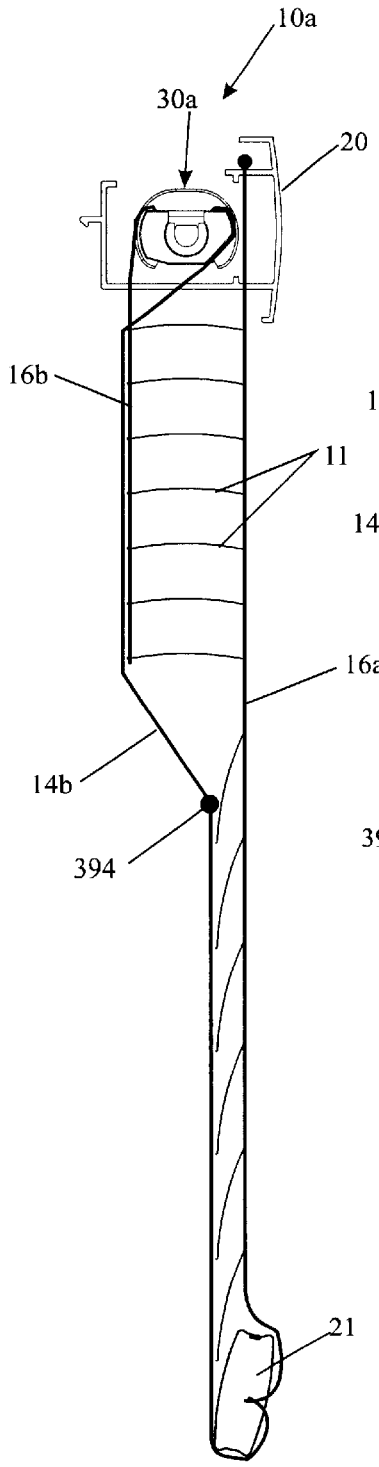
FIG. 13A is a schematic cross-sectional view of a blind, similar to the schematic view of FIG. 12A, but for a second embodiment of the present invention showing the upper portion of the blind fully open and the lower portion of the blind fully closed room side up.
Figure 13B:
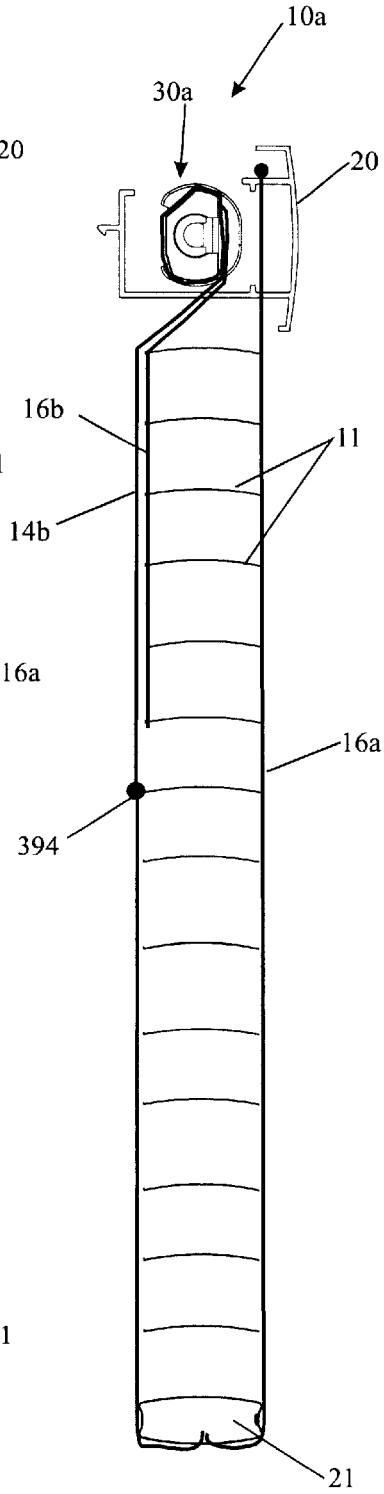
FIG. 13B is the same view as in FIG. 13A, but with the tape drum rotated 270 degrees to the position corresponding to the blind in the fully open position.
Figure 13C:
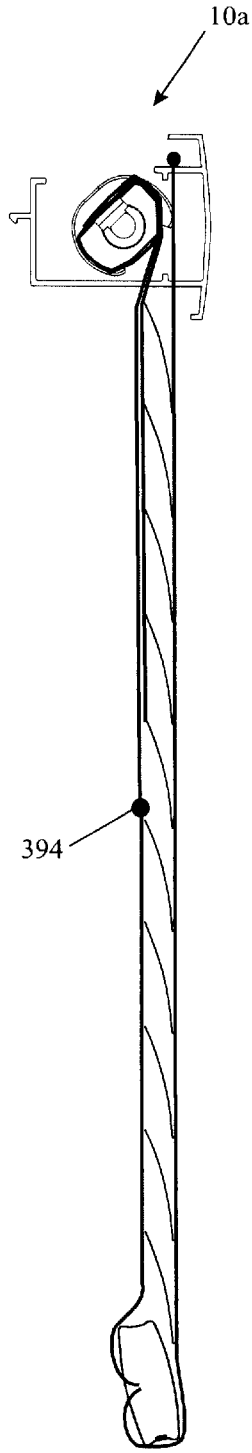
FIG. 13C is the same view as in FIG. 13A, but with the tape drum rotated 405 degrees to the position corresponding to the blind in the fully closed position room side down.
Figure 14:
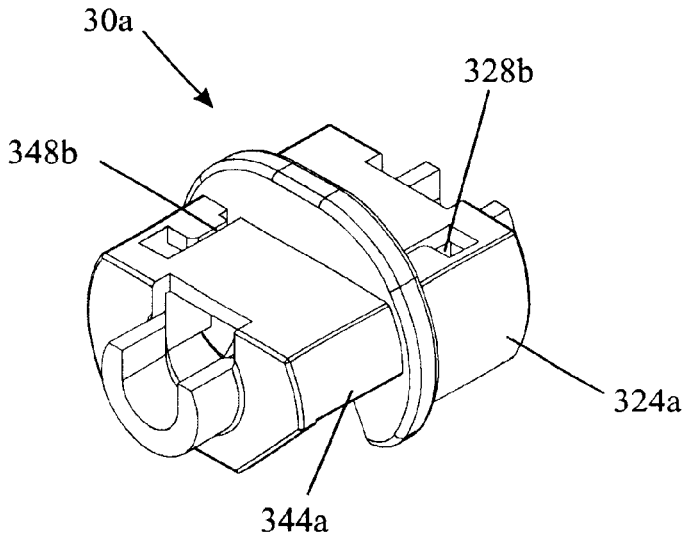
FIG. 14 is a perspective view of the one-piece tape drum used in the second embodiment of the present invention, depicted in FIGS. 13A, 13B, and 13C.
Figure 15:
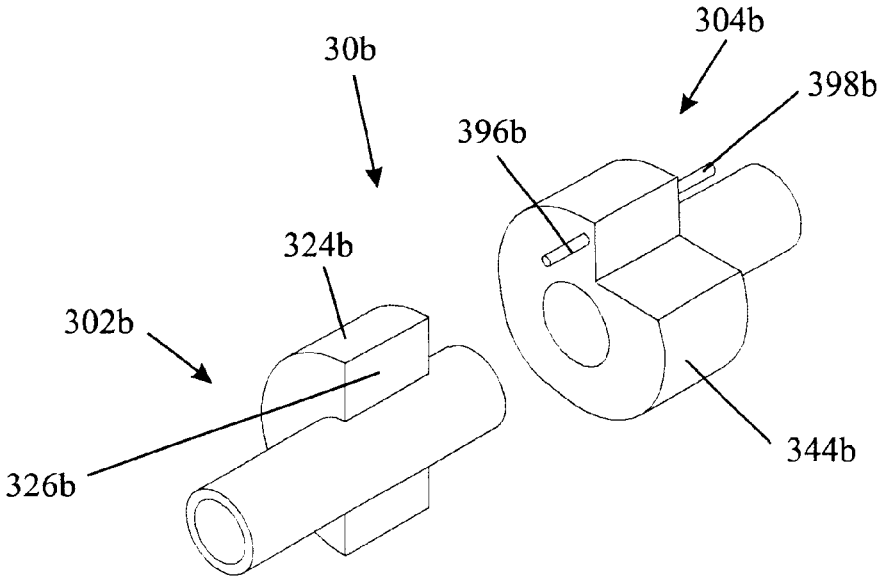
FIG. 15 is a schematic exploded perspective view of a two-piece tape drum used in a third embodiment of the present invention.

FIGS. 13A, 13B, and 13C show a second embodiment of a blind 10*a*, which uses a single-piece tape drum 30A, shown in FIG. 14. This single-piece tape drum 30A is in fact very similar to the two-piece tape drum 302, 304 of the first embodiment, even though the specific geometry of the truncated cylindrical projections 324A, 344A of the single-piece tape drum 30A differ slightly from the corresponding surfaces 324, 344 of the two-piece tape drum 30 in order to account for the correct lag in pulling on the actuator cord 14B.

In this second embodiment, the front tilt cable 16A is secured to the head rail 20 (See FIG. 13B), the rear tilt cable 16B is secured to the rear slotted opening 348B of the tape drum 30A and extends only as far as the "break" point 394, where it is terminated. The actuator cord 14B is secured to the front slotted opening 328B and extends all the way to the bottom rail 21. The actuator cord 14B is secured to the bottom rail 21 in a similar manner as the front tilt cable 16A is secured to the bottom rail 21. The actuator cord 14B is also secured to all the ladders 17 supporting the slats 11 located at or below the break point 394 but is not connected to any of the ladders 17 supporting the slats 11 located above the break point 394. So, the actuator cord 14B effectively is one of the tilt cables for the lower portion of the blind.

The lengths of the tilt cables 16A, 16B and of the actuator cord 14B are adjusted so that, when the tape drum 30A is fully rotated clockwise (as seen from the vantage point of FIG. 13A), the bottom portion of the blind 10A is tilted closed room side up, and the upper portion of the blind 10A is tilted open. As the tilt wand 24 is rotated so that the tilter 28 in turn rotates the tilt rod 26 and the tape drum 30A counter-clockwise, the length of the rear tilt cable 16B remains unchanged so that the upper portion of the blind 10A remains tilted open. However, the actuator cord 14B wraps around the surface 324A of the tape drum 30A and is thus shortened, bringing the lower portion of the blind 10A to the tilted open position as shown in FIG. 13B. This corresponds to a counterclockwise rotation of 270 degrees from the initial position of FIG. 13A. Further counter-clockwise rotation of the tape drum 30A to a position which is 405 degrees from the initial position results in both the rear tilt cable 16B and the actuator cord 14B wrapping on the surfaces 344A, 324A of the tape drum 30A, respectively, thus shortening these cords 16B, 14B, bringing both the upper and lower portions of the blind 10A to the tilted closed position room side down as shown in FIG. 13C. As in the case of the first embodiment, reversing the direction of rotation merely reverses the events described above.

In this embodiment, the two portions 324A, 344A of the tape drum 30A are positively driven together by the tilt rod 26. This non-slip positive engagement drive is formed by the non-circular cross-section outer surface of the tilt rod 26 engaging the non-circular cross-section inner surface of the tape drum 30A.

FIGS. 15–18B show a third embodiment of a blind 10B. This embodiment 10B uses a two-piece tape drum 30B as shown schematically in FIG. 15. This two-piece tape drum 30*b*, including the drive drum portion 302B and the driven drum portion 304B, is in fact very similar to the two-piece tape drum 302, 304 of the first embodiment, even though the specific geometry of the truncated cylindrical projections 324B, 344B of the tape drum 30B differ slightly from the corresponding surfaces 324, 344 of the tape drum 30 in order to account for the correct lag in pulling on the actuator cord 14A. The driven drum portion 304B has a first projection 396B, which engages the flat 326B on the drive drum 302B and a second projection 398B which engages the short leg 384 of the arm 362 of the cradle 306 to serve as a first limit stop. The second projection 398B engages the long leg 382 of the arm 362 of the cradle 306 to serve as a second limit stop.

In this third embodiment 10B, the front tilt cable 16A is secured to the head rail 20, the rear tilt cable 16B is secured to the driven drum 304B, and the actuator cord 14A is secured to the drive drum 302B and extends down to the break point 394, where it attaches to the front tilt cable 16A via the clip 32 as has already been described.

Figure 16A:
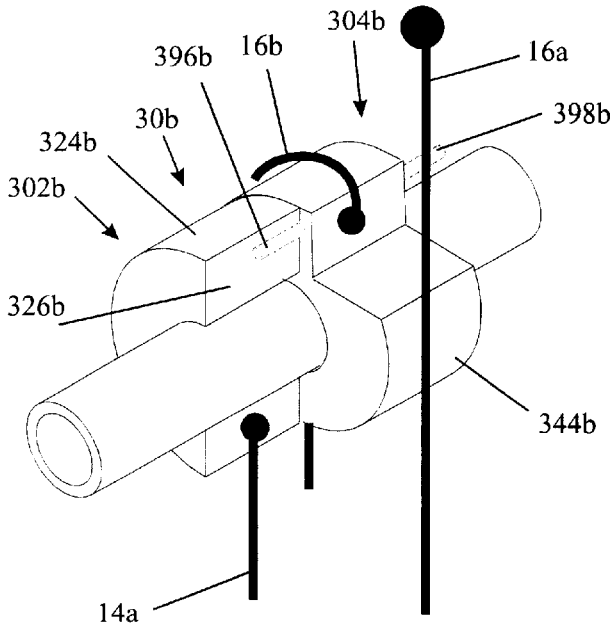
FIG. 16A is a schematic perspective view of the assembled tape drum of FIG. 15, including the tilt cables, and the actuator cord, in the position corresponding to the fully closed blind depicted in FIG. 16B.
Figure 16B:
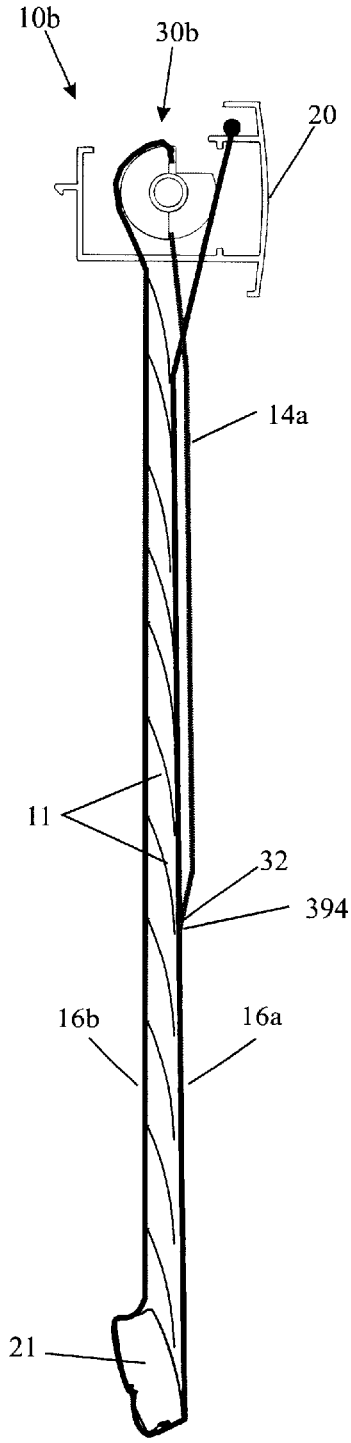
FIG. 16B is a schematic cross-sectional view of a blind, similar to the schematic view of FIG. 13A, but using the tape drum of FIG. 15, showing the blind fully closed room side down.
Figure 17A:
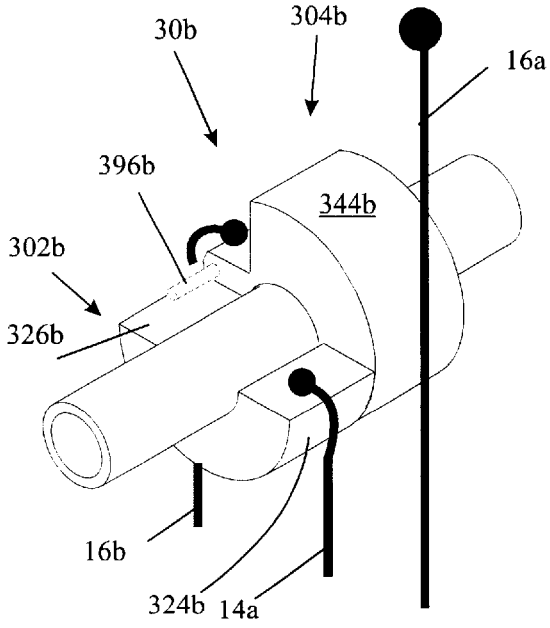
FIG. 17A is the same view as FIG. 16A but with the tape drum rotated 90 degrees to the position where the blind is in the fully open position.
Figure 17B:
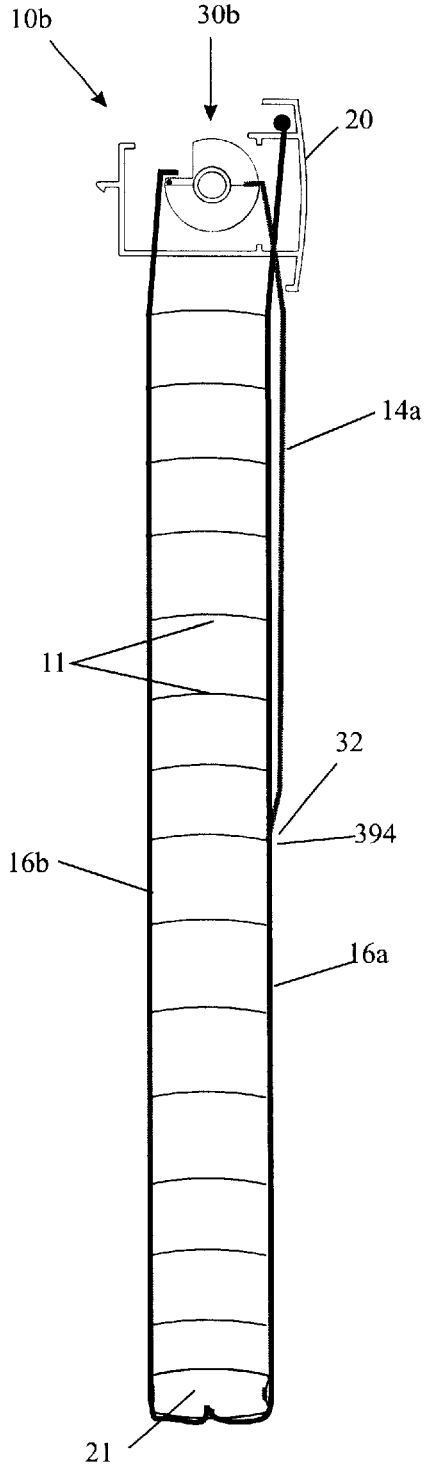
FIG. 17B is the same view as FIG. 16B but showing the fully open position, with the tape drum in the position shown in FIG. 17A.

The lengths of the tilt cables 16A, 16B and of the actuator cord 14A are adjusted so that, when the tape drum 30B is fully rotated clockwise, with the projection 398B of the driven drum portion 304B stopped against the cradle and the drive drum portion 302B stopped against the driven drum portion 304B, the entire blind 10B is tilted closed room side down, as shown in FIG. 16B. The flat 326B on the drive drum 302B pushes against the first projection 396B of the driven drum 304B, holding the rear tilt cable 16B pulled up against the weight of the blind stack, and holding the blind in the closed position of FIG. 16B. As the tilt wand 24 is rotated so that the tilter 28 in turn rotates the tilt rod 26 and the drive drum 302B counter-clockwise to a new position which is 90 degrees from the position of FIG. 16B, the driven drum 304B also rotates counter-clockwise 90 degrees, forced open by the weight of the blind stack pulling on the rear tilt cable 16B. This lengthens the rear tilt cable 16B as it unwinds from the surface 344B of the driven drum 304B so that the entire blind 10B is tilted open as shown in FIG. 17B. The relative positions of the drive and driven drums 302B, 304B and of the tilt cables 16A, 16B and the actuator cord 14A at this position are shown in FIG. 17A. As the drive drum 302B continues to rotate counter-clockwise, the second projection 398B on the driven drum 304B contacts against the leg 384 of the arm 362 of the cradle 306, which stops the driven drum 304B from further counter-clockwise rotation.

Figure 18A:
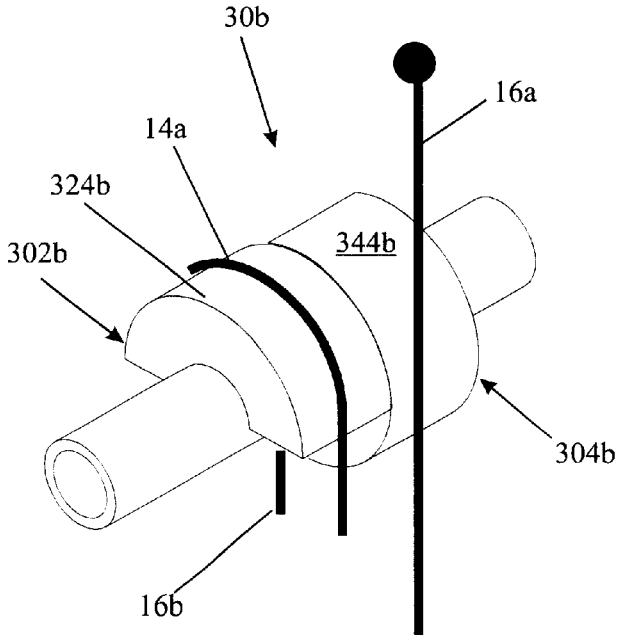
FIG. 18A is the same view as FIG. 16A but with the tape drum rotated 270 degrees to the position where the upper portion of the blind is fully open and the lower portion of the blind is fully closed room side up as shown in FIG. 18B.
Figure 18B:
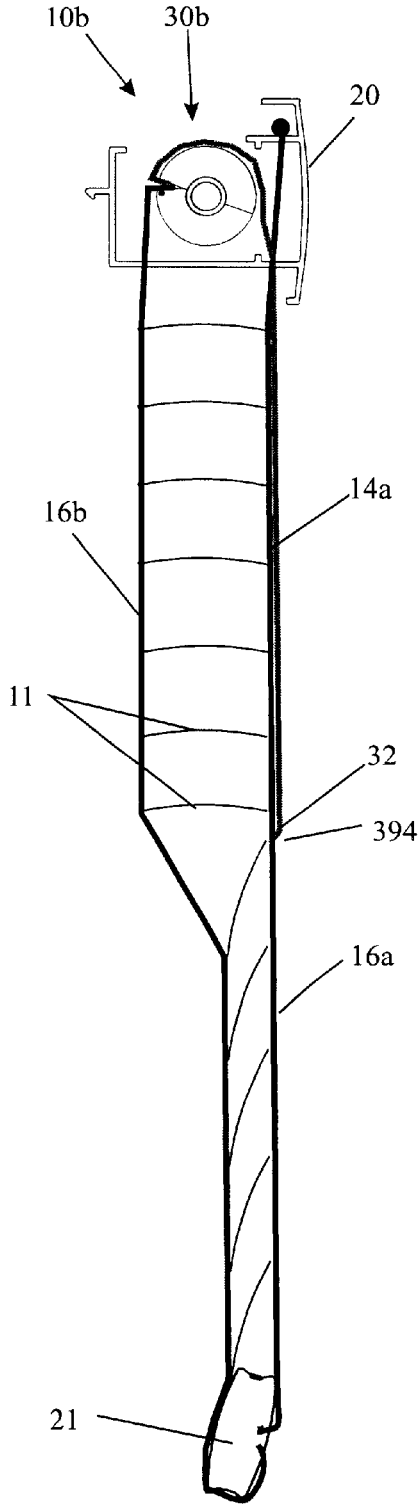
FIG. 18B is the same view as FIG. 16B but showing the upper portion of the blind open and the lower portion of the blind closed room side up, corresponding to the tape drum position shown in FIG. 18A.
Figure 19:
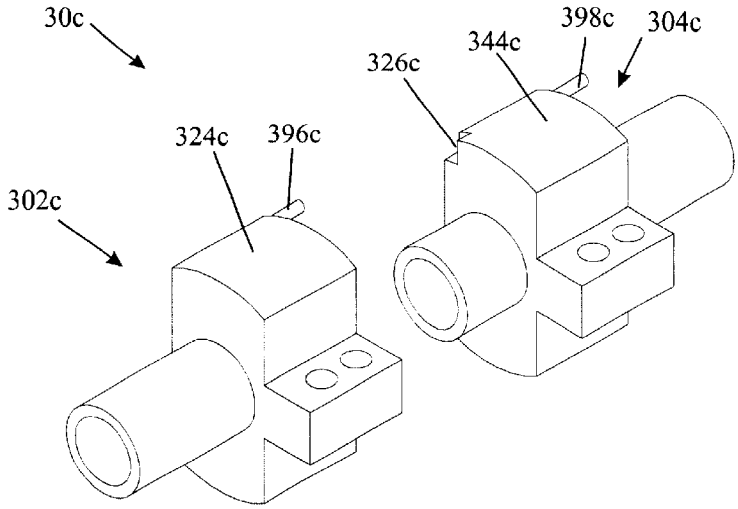
FIG. 19 is a schematic exploded perspective view of a two-piece tape drum used in a fourth embodiment of the present invention.
Figure 20:
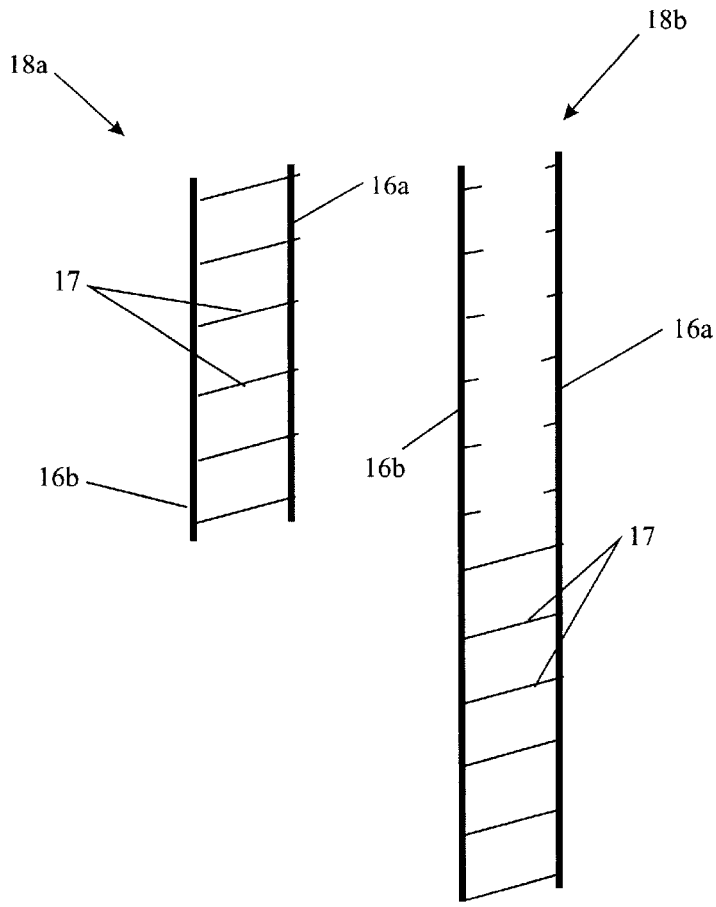
FIG. 20 is a schematic perspective view of the upper ladder tape and the lower ladder tape used in the fourth embodiment.
Figure 21A:
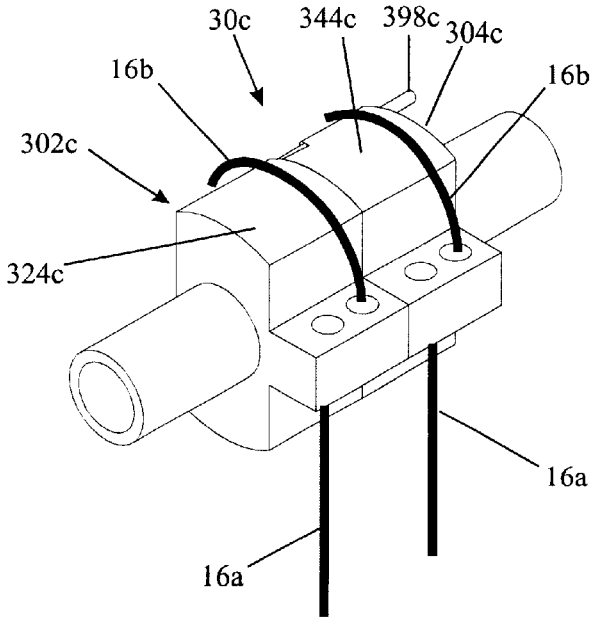
FIG. 21A is a schematic perspective view of the assembled tape drum of FIG. 19 and the ladder tapes of FIG. 20, in the position corresponding to the fully closed blind depicted in FIG. 21B.
Figure 21B:
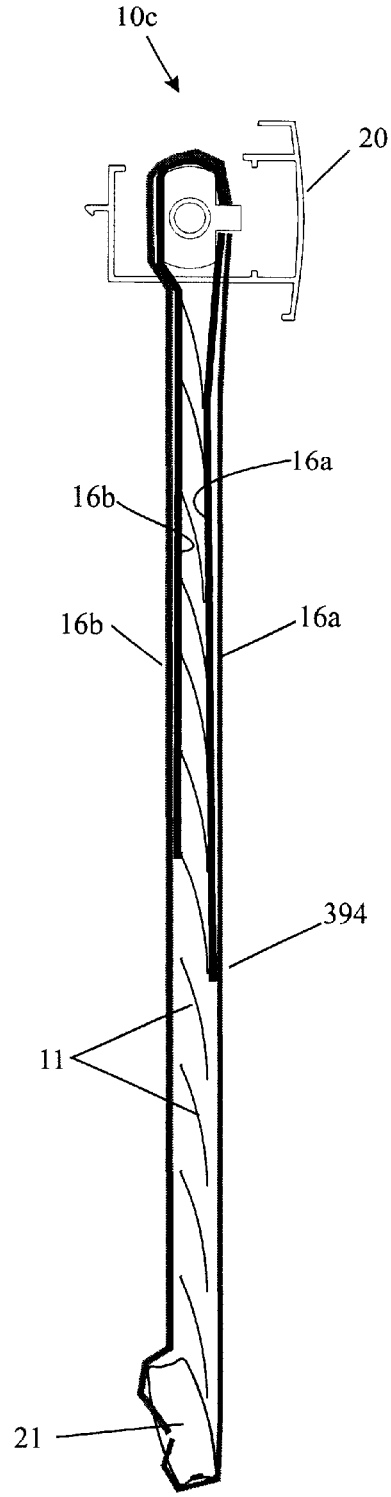
FIG. 21B is a schematic cross-sectional view of a blind, similar to the schematic view of FIG. 13A, but for the fourth embodiment of the present invention, showing the blind fully closed room side down.

Further counter-clockwise rotation of the drive drum 302B to a position which is 270 degrees from the initial position (initial position is shown in FIG. 16B) results in the actuator cord 14A wrapping onto the surface 324B of the drive drum 302B, thus shortening this cord 14A, bringing the lower portion of the blind 10B to the tilted closed position room side up as shown in FIG. 18B. The relative positions of the drive and driven drums 302B, 304B and of the tilt cables 16A, 16B and the actuator cord 14A when the blind is in this position are shown in FIG. 18A. As in the case of the other embodiments, reversing the direction of rotation reverses the events described above.

FIGS. 19–23B show a fourth embodiment of a blind 10C. This embodiment uses a two-piece tape drum 30C, shown schematically in FIG. 19. This two-piece tape drum 30C, including drive drum portion 302C and driven drum portion 304*c*, is very similar to the two-piece tape drum 302, 304 of the first embodiment, even though the specific geometry of the surfaces 324C, 344C of the tape drum 30C may differ slightly from the corresponding surfaces 324, 344 of the tape drum 30 in order to account for the correct lag in pulling on the different ladder tapes 18A and 18B of FIG. 20. The driven drum portion 304C has a projection 398C, which engages the short leg 384 of the arm 362 of the cradle 306 to serve as a limit stop. The drive drum portion 302C has a projection 396C, which engages the flat driven surface 326C on the driven drum portion 304C.

In this fourth embodiment 10C, there are two sets of ladder tapes 18A and 18B (See FIG. 20), each including cross cords 17, supporting a set of slats 11, with the cross cords tied to front and rear cables 16A, 16B, respectively. The first ladder tape 18A is shorter than the second ladder tape 18B, in that it only extends down as far as the break point 394 on the blind 10C (See FIG. 22B). The second ladder tape 18B extends all the way down to the bottom rail 21, but it does not have cross cords 17 above the break point 394. The longer set of cables 16A, 16B, corresponding to the longer ladder tape 18B is attached to the drive drum portion 302C, and the shorter set of cables 16A, 16B corresponding to the shorter ladder tape 18A, is attached to the driven drum portion 304C such that, when the drive drum portion 302C and the driven drum portion 304C are in the initial position shown in FIG. 22A, the entire blind 10C is in the tilted open position of FIG. 22B.

As the drive drum portion 302C is rotated clockwise, the projection 396C on the drive drum portion 302C contacts the flat driven surface 326C on the driven drum portion 304C, driving the drum portions 302C, 304C clockwise 90 degrees, until the projection 398C on the driven drum portion 304C contacts the long leg 382 of the arm 362 of the cradle 306, serving as a first limit stop. At this point, the entire tilting mechanism comes to a stop at the position shown in FIGS. 21A and 21B, with the entire blind 10C tilted closed room side down. The projection 396C on the drive drum portion 302C pushes against the flat driven surface 326C of the driven drum portion 304*c*, and the rear tilt cables 16B of both ladder tapes 18*a*, 18B are pulled up against the weight of the blind stack.

Figure 22A:
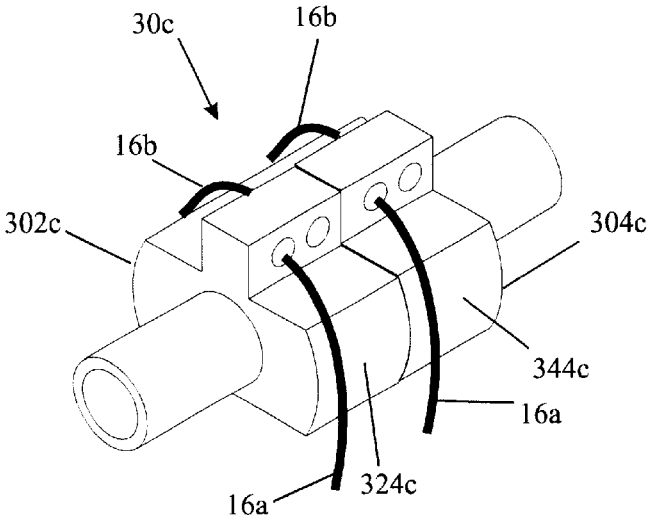
FIG. 22A is the same view as FIG. 21A but with the tape drum rotated 90 degrees to the position where the blind is in the fully open position.
Figure 22B:
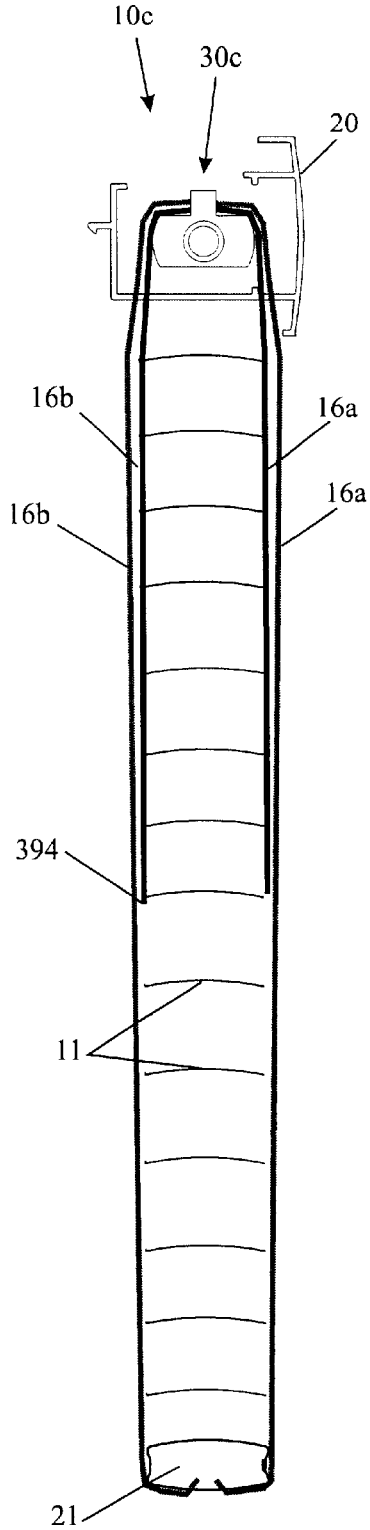
FIG. 22B is the same view as FIG. 21B but showing the blind in the fully open position, with the tape drum in the position shown in FIG. 22A.

As the tilt wand 24 is rotated in the opposite direction, so that the tilter 28 in turn rotates the tilt rod 26 and the drive drum 302C counter-clockwise 90 degrees, back to the initial position, the projection 396C on the drive drum contacts a detent (not shown) on the driven drum 304C to cause the driven drum 304C to rotate counter-clockwise 90 degrees back to its initial position, returning to the initial position shown in FIGS. 22A, 22B, with the entire blind open.

Figure 23A:
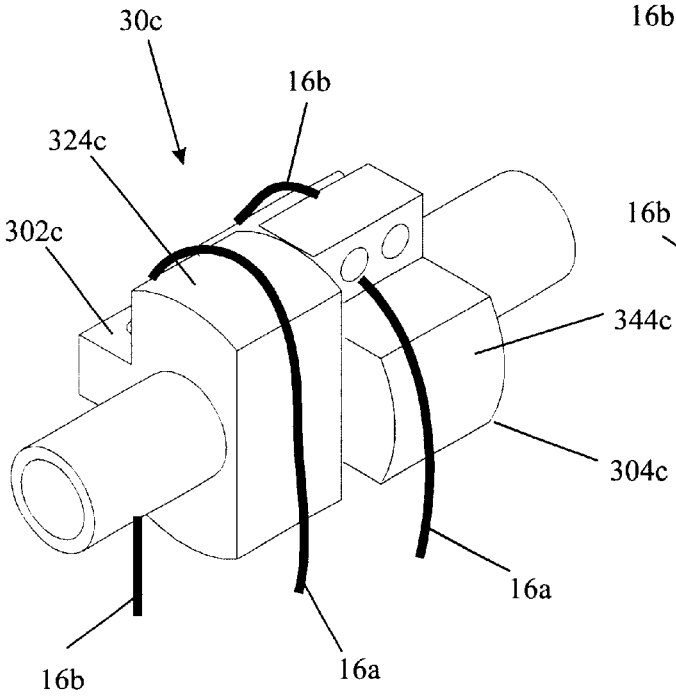
FIG. 23A is the same view as FIG. 21A but with the tape drum rotated 180 degrees to the position where the upper portion of the blind is fully open and the lower portion of the blind is fully closed room side up as shown in FIG. 23B.
Figure 23B:
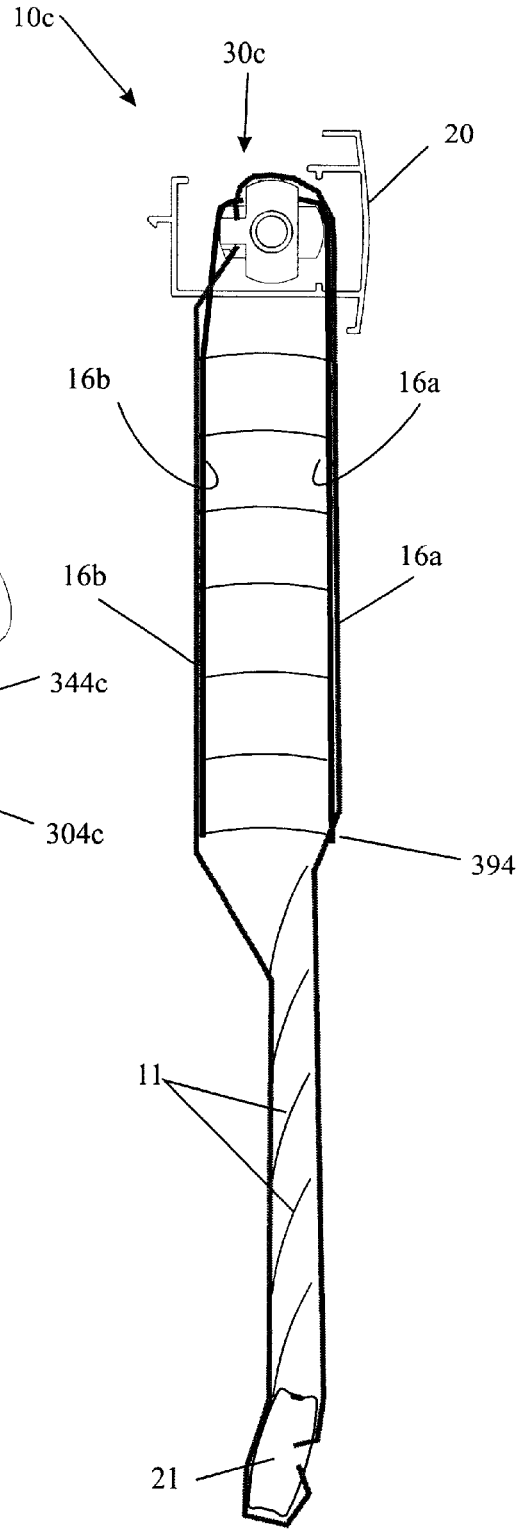
FIG. 23B is the same view as FIG. 21B but with the upper portion of the blind fully open and the lower portion of the blind fully closed room side up, corresponding to the tape drum in the position shown in FIG. 23A.
Figure 24A:
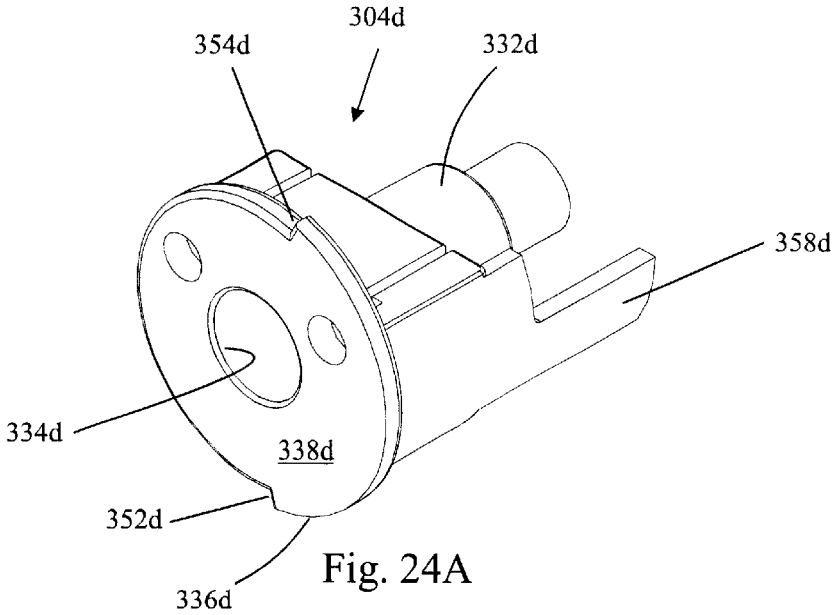
FIG. 24A perspective view of a driven drum, similar to that of FIG. 5A, but for a fifth embodiment of the present invention, without the "catch" or detent present in the driven drum of FIG. 5.
Figure 24B:
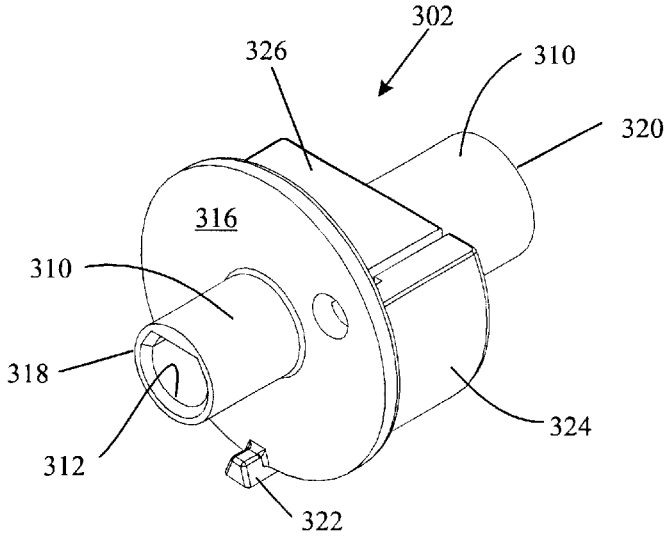
FIG. 24B is perspective view of a drive drum, similar to that of FIG. 6B, but for the fifth embodiment of the present invention.
Figure 24C:
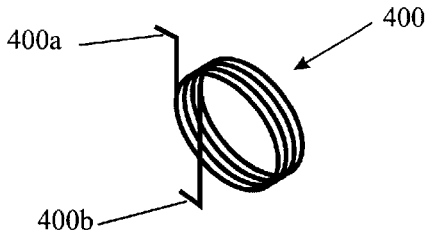
FIG. 24C is a perspective view of the torsional spring used in the fifth embodiment of the present invention.

As the drive drum 302C continues rotating counterclockwise, a projection from the driven drum 304C contacts the cradle, stopping the driven drum 304C in the open position, while the drive drum rotates 90 degrees counterclockwise from its initial position of FIG. 22A to the position shown in FIG. 23A. At this point, the front tilt cable 16A of the long ladder tape 18B has wrapped onto the surface 324C of the drive drum 302C, thus shortening this long cable 16A, bringing the lower portion of the blind 10C to the tilted closed position room side up as shown in FIG. 23B. Thus, with 90 degrees of rotation of the driven drum and 180 degrees of rotation of the drive drum, the blind can go from a position that is fully closed room side down, to an open position, to a position with the top portion open and the bottom portion closed room side up. As in the case of the other embodiments, reversing the direction of rotation merely reverses the events described above.

FIGS. 24A–25D show a fifth embodiment of a blind 10D. This embodiment uses a two-piece tape drum 30D. This two piece tape drum 30D is very similar to the two-piece tape drum 302, 304 of the first embodiment, with the difference being that the projection or catch 356 in the driven drum 304 has been eliminated, and a torsional spring 400 (See FIGS. 24C and 25B) is used instead, as is described below.

Figure 25A:
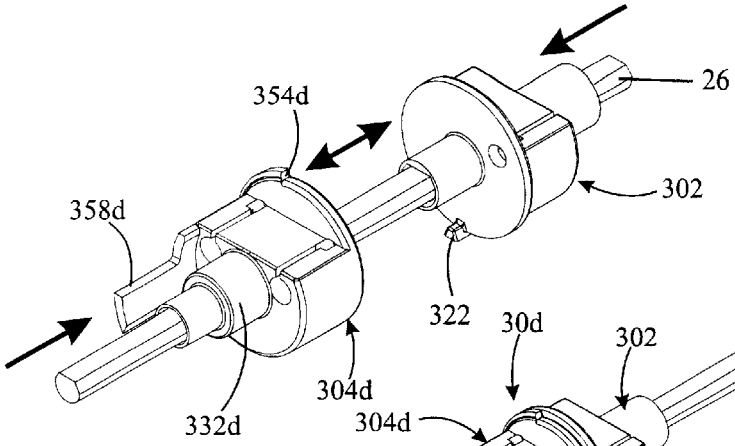
FIG. 25A is an exploded, perspective view of the drive and driven drums of FIGS. 24A and 24B as they are being mounted onto the tilt rod.
Figure 25B:
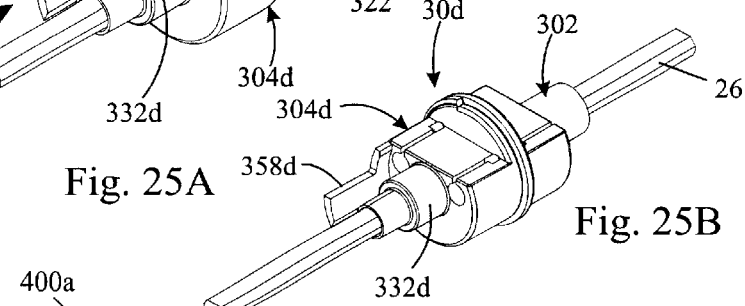
FIG. 25B is a partially exploded view, similar to FIG. 25A, but with the addition of the torsional spring.
Figure 25C:
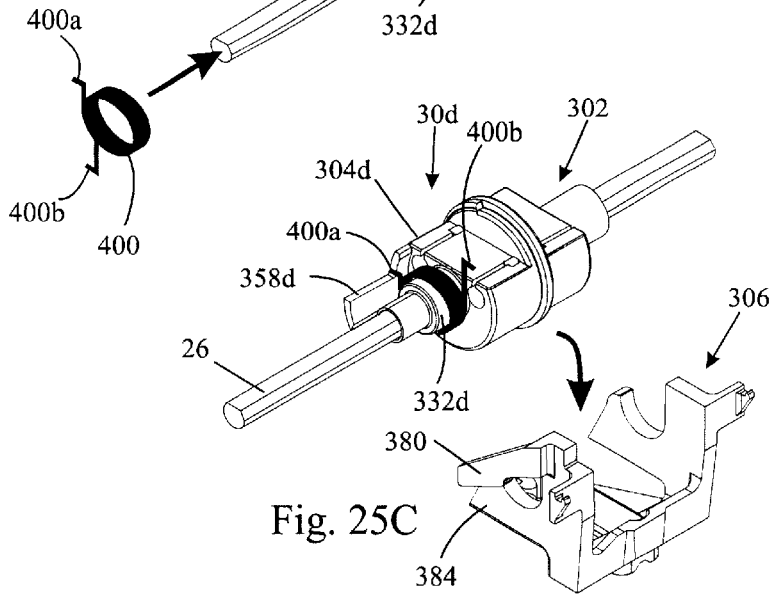
FIG. 25C is a partially exploded view, similar to FIG. 25B, but with the addition of the cradle or tape roll support.
Figure 25D:
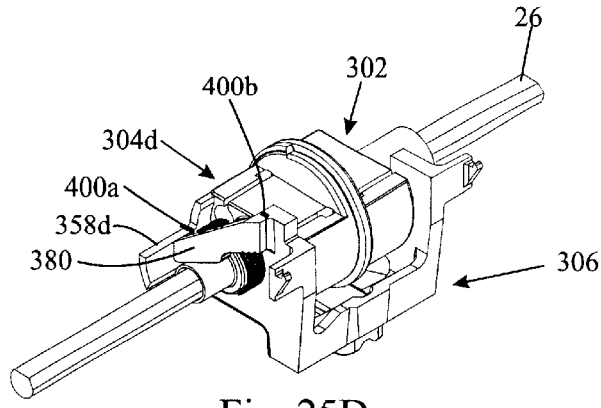
FIG. 25D is a perspective view of the assembled tilt station of the fifth embodiment of the present invention.

The torsional spring 400 has a first end 400A and a second end 400B. As shown in FIGS. 25B, 25C, and 25D, the spring 400 is mounted onto the shaft 332D of the driven drum portion 304D, with the first end 400A engaging the wing 358D of the driven drum portion 304D, and the second end 400B engaging the cradle 306 at the base of the projection 380. The spring 400 biases the driven drum 304D in the counter-clockwise direction.

Except for the absence of the detent projection 356 on the driven drum 304, and the replacement of its function by the torsional spring 400 engaging the new driven drum 304D, this fifth embodiment operates in the same manner as the first embodiment described above. Referring briefly to FIGS. 12A, 12B, and 12C, and considering the position of FIG. 12B to be the starting point, when the tilt rod 26 is rotated clockwise, it drives the drive drum 302 clockwise, and the driving surface on the projection 322 of the drive drum 302 engages the driven surface 352D on the driven drum 304D, forcing the driven drum 304D also to rotate clockwise 90 degrees to the position shown in FIG. 12A. This causes the end 400A of the spring 400 also to rotate clockwise, compressing the spring 400. At this point, the blind is closed, room side down, as seen in FIG. 12A.

As the tilt rod 26 is rotated back counter-clockwise 90 degrees to the position shown in FIG. 12B, the compressed spring 400 pushes against the wing 358D of the driven drum 304D, causing the driven drum 304D to rotate counter-clockwise as well, and keeping the step 352D of the driven drum 304D pressed against the driving projection 322 of the drive drum 302. When the blind reaches the open position depicted in FIG. 12B, the wing 358D on the driven drum 304D contacts the leg 384 of the cradle 306, stopping the driven drum 304D.

Further counter-clockwise rotation of the tilt rod 26 results in rotation of the drive drum 302 only, for approximately 180 degrees. The actuator cord 14 wraps onto the drive drum 302, until the projection 322 on the drive drum 302 hits against the second driven surface 354D on the driven drum 304D, causing the drive drum 302 to stop in the position depicted in FIG. 12C, with the top portion of the blind in the open position and the bottom portion of the blind, below the "break" point 394, in the closed position, room side up. As in the case of the first embodiment, reversing the direction of rotation of the tilt rod reverses the events described above.

The projection 322 on the drive drum 302 no longer has to "jump" over the detent on the driven drum 304D, since there is no longer a detent 356 on the driven drum 304D in this fifth embodiment. As a result, the user no longer experiences a sharp increase in force to engage or disengage the driven drum 304D.

Figure 26A:
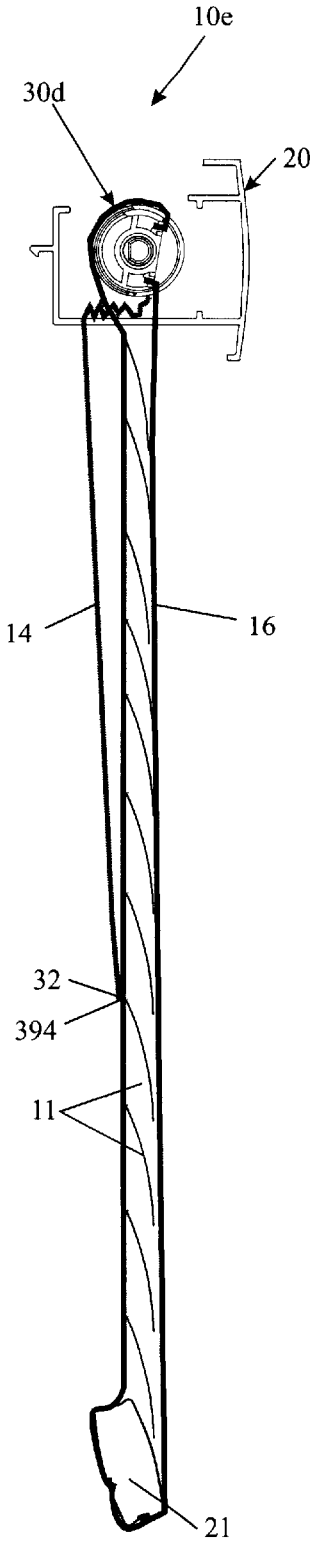
FIG. 26A is a schematic cross-sectional view of a blind, similar to the schematic view of FIG. 12A, but for a sixth embodiment of the present invention, showing the blind fully closed room side down.
Figure 26B:
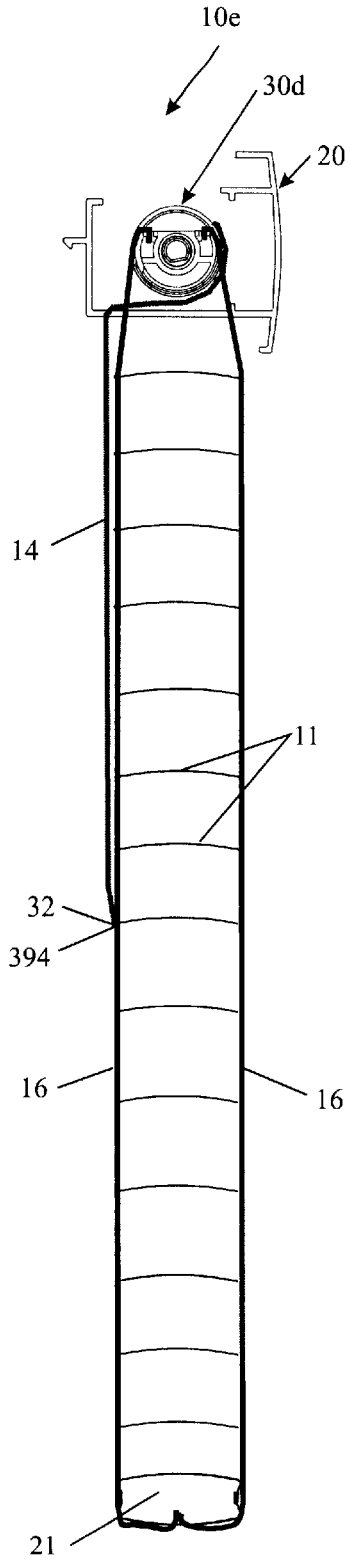
FIG. 26B is the same view as in FIG. 26A, but with the tape drum rotated 90 degrees to the position corresponding to the blind in the fully open position.
Figure 26C:
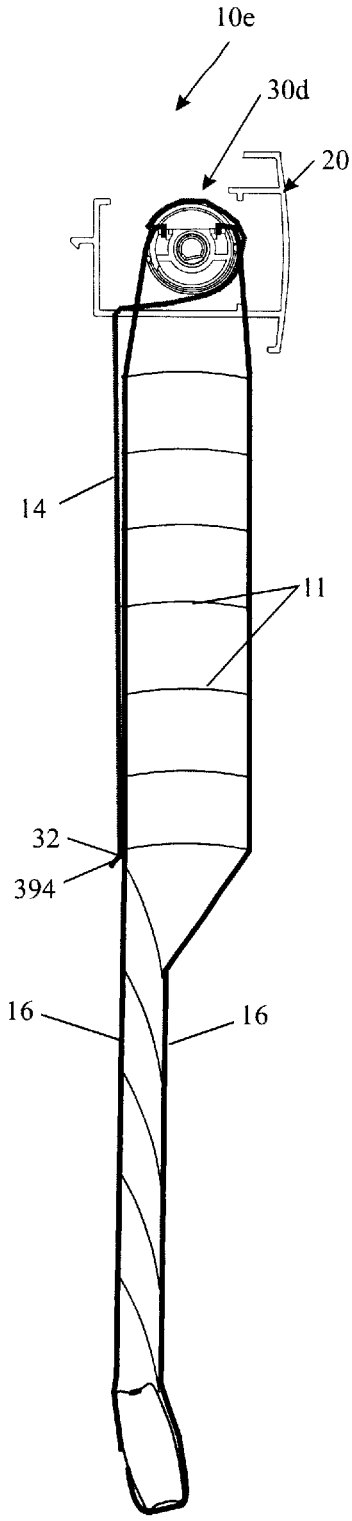
FIG. 26C is the same view as in FIG. 26A, but with the tape drum rotated 270 degrees to the position showing the upper portion of the blind fully open and the lower portion of the blind fully closed room side down.

FIGS. 26A, 26B, and 26C depict a sixth embodiment 10E of a blind manufactured in accordance with the present invention. This embodiment 10E is identical in its components to the first embodiment 10 onto the fifth embodiment 10D described above. The difference is that the actuator cord 14 in this sixth embodiment 10E is secured to the rear tilt cable instead of to the front tilt cable. The net effect is that, in one position of the tape drum 30D, when it is rotated fully in the counter-clockwise direction (as seen from the vantage point of FIG. 26C), the actuator cord 14 pulls up on the rear tilt cable 16 at the break point 394, resulting in the lower portion of the blind 30D being closed room side down (as shown in FIG. 26C) instead of being closed room side up (as shown in FIG. 12C).

For all the embodiments described above, the use of the terms "front" and "back", "inside" and "outside" with respect to the blind and slats are arbitrary, and it is obvious that the blind could be turned around, so that the front becomes the back, the inside becomes the outside, and vice versa. Also, the construction could be reversed, so that the entire blind closed with the inside edges up instead of down, and the lower portion closed with the inside edges down instead of up.

Figure 27:
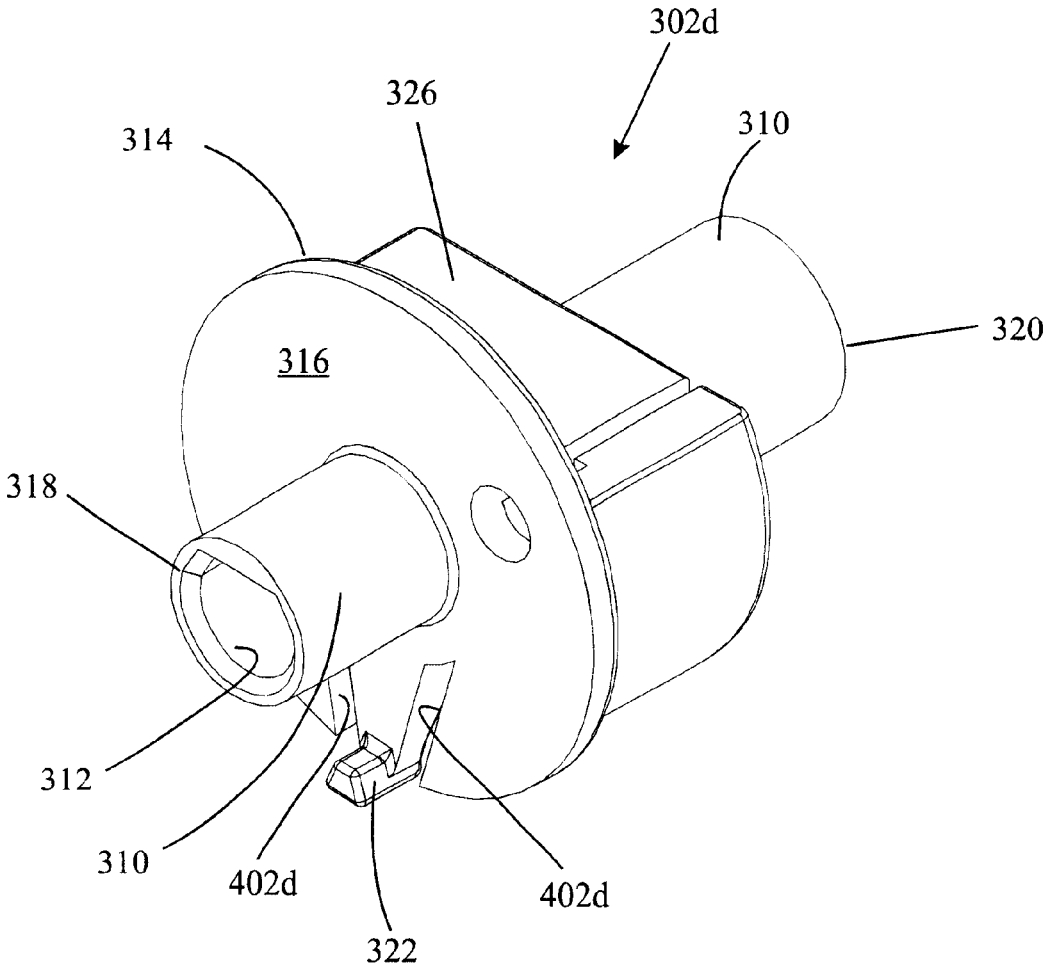
FIG. 27 is a perspective view of an alternate embodiment of the drive drum portion (the right half) of the drum shown in FIG. 1.

FIG. 27 illustrates an alternate embodiment of the drive drum 302D, which may be used with any of the previously described embodiments using two-piece tape drums. The finger 322 in this drive drum 302D has two radially directed slots 402D on the flat shoulder 316 such that the finger 322 has some flexibility to spring out of the way when it hits against the detent 356 in the driven drum 304. The jump by the finger 322 over the detent 356 is therefore easier, requiring the use of less force by the user who is thus less likely to interpret the detent 356 as a limit stop.

While several embodiments of the present invention have been shown and described, it is not practical to describe all the possible variations and combinations that could be made within the scope of the present invention. It will be obvious to those skilled in the art that modifications may be made to the embodiments described above without departing from the scope of the invention as claimed.

What is claimed is:

1. A tilter mechanism for selectively tilting portions of a covering for architectural openings, comprising:

a tape drum mounted for rotation about a longitudinal axis;

a first limit stop to limit the rotation of said tape drum in a first direction;

at least one ladder tape including a front tilt cable and a rear tilt cable, at least one of said front and rear tilt cables being connected to said tape drum, such that the connected cable is raised and lowered with the rotation of said tape drum; and at least one actuator cord having a first point secured to one of said front and rear tilt cables and a second point secured to said tape drum, wherein rotation of said tape drum raises and lowers said actuator cord.

2. A tilter mechanism for selectively tilting portions of a covering for architectural openings as recited in claim 1, and further comprising means for effecting a lag between the raising of said one tilt cable and the raising of said actuator cord as said tape drum rotates.

3. A tilter mechanism for selectively tilting portions of a covering for architectural openings as recited in claim 2, and further comprising a second limit stop to limit rotation of said tape drum in a second direction.

4. A tilter mechanism for selectively tilting portions of a covering for architectural openings as recited in claim 3, wherein said tape drum comprises a drive drum portion and a driven drum portion, and wherein said drive drum portion has a first range of motion and drives said driven drum portion, and wherein said limit stops restrict the rotation of said driven drum to a second range of motion which is less than said first range of motion.

5. A tilter mechanism for selectively tilting portions of a covering for architectural openings as recited in claim 4, wherein said drive drum portion has first and second driving surfaces and said driven drum portion has first and second driven surfaces, and wherein rotation of said drive drum portion in said first direction causes said first driving surface to contact said first driven surface in order to drive said driven drum portion in said first direction, and wherein rotation of said drive drum portion in said second direction causes said second driving surface to contact said second driven surface in order to drive said driven drum portion in said second direction.

6. A tilter mechanism for selectively tilting portions of a covering for architectural openings as recited in claim 5, and further comprising:

a tape drum mounting cradle, wherein said tape drum is mounted in said cradle for rotation relative to said cradle; and a cradle-impacting member on said driven drum portion, which contacts said cradle at a first angular position in order to form said first limit stop.

7. A tilter mechanism for selectively tilting portions of a covering for architectural openings as recited in claim 6, wherein said cradle-impacting member on said driven drum portion contacts said cradle at a second angular position in order to form said second limit stop.

8. A tilter mechanism for selectively tilting portions of a covering for architectural openings as recited in claim 7, wherein said front and rear tilt cables of said ladder tape are secured to said driven drum portion, and said second point of said actuator cord is secured to said drive drum portion.

9. A tilter mechanism for selectively tilting portions of a covering for architectural openings as recited in claim 8, wherein said first range of motion of said tape drum is less than 360 degrees.

10. A tilter mechanism for selectively tilting portions of a covering for architectural openings as recited in claim 9, wherein said driven drum portion further comprises a detent adjacent to said first driven surface such that one of said first and second driving surfaces on said drive drum portion engages said detent to rotationally drive said driven drum portion.

11. A tilter mechanism for selectively tilting portions of a covering for architectural openings as recited in claim 9, and further comprising a torsional biasing spring which rotationally biases said driven drum portion in one of said first and second directions.

12. A tilter mechanism for selectively tilting portions of a covering for architectural openings as recited in claim 6, and further comprising a frame member, wherein the other of said front and rear tilt cables of said ladder tape is secured to said frame member, and said second point of said actuator cord is secured to said drive drum portion of said tape drum.

13. A tilter mechanism for selectively tilting portions of a covering for architectural openings as recited in claim 12, wherein said first range of motion of said drive drum is less than 360 degrees.

14. A tilter mechanism for selectively tilting portions of a covering for architectural openings as recited in claim 13, wherein said driven drum portion further comprises a detent adjacent to said first driven surface such that one of said first and second driving surfaces on said drive drum portion may also engage said detent to rotationally drive said driven drum portion.

15. A tilter mechanism for selectively tilting portions of a covering for architectural openings as recited in claim 13, and further comprising a torsional biasing spring which rotationally biases said driven drum portion in one of said first and second directions.

16. A tilter mechanism for selectively tilting portions of a covering for architectural openings as recited in claim 1, wherein said tape drum comprises a drive drum portion and a driven drum portion, wherein said drive drum portion has a first range of motion and drives said driven drum portion, and wherein said front and rear tilt cables of said ladder tape are secured to said driven drum portion, and said second point of said actuator cord is secured to said drive drum portion.

17. A tilter mechanism for selectively tilting portions of a covering for architectural openings as recited in claim 1, wherein said tape drum includes first and second portions, and further comprising:

a tilt rod, wherein at least one of said front and rear cables is connected to said first portion of said tape drum and said actuator cord is connected to said second portion of said tape drum; and non-slip positive engagement drive means for driving said first and second portions of said tape drum from said tilt rod.

18. A tilter mechanism for selectively tilting portions of a covering for architectural openings, comprising:

a tilt rod;

a tape drum mounted for rotation about a longitudinal axis, said tape drum including first and second portions;

at least a first ladder tape having a first length and including a first front tilt cable, a first rear tilt cable, and a first set of cross cords supporting a first set of slats, at least one of said first front and rear cables being connected to said first portion of said tape drum, wherein rotation of said first portion of said tape drum raises and lowers said one first tilt cable;

at least a second ladder tape, longer than said first ladder tape, including a second front tilt cable, a second rear tilt cable, and a second set of cross cords supporting a second set of slats, at least one of said second front and rear tilt cables being connected to said second portion of said tape drum, wherein rotation of said second portion of said tape drum raises and lowers said one second tilt cable, and non-slip positive engagement drive means for driving said first and second portions of said tape drum from said tilt rod.

19. A tilter mechanism for selectively tilting portions of a covering for architectural openings as recited in claim 18, and further comprising:

a first limit stop to limit rotation of said tape drum in a first direction about said axis.

20. A tilter mechanism for selectively tilting portions of a covering for architectural openings as recited in claim 19, and further comprising:

a second limit stop to limit rotation of said tape drum in a second direction about said axis.

21. A tilter mechanism for selectively tilting portions of a covering for architectural openings, comprising:

a tape drum mounted for rotation about a longitudinal axis;

at least a first ladder tape having a first length and including a first front tilt cable, a first rear tilt cable, and a first set of cross cords supporting a first set of slats, at least one of said first front and rear cables being connected to said tape drum, wherein rotation of said tape drum raises and lowers said one first tilt cable;

at least a second ladder tape, longer than said first ladder tape, including a second front tilt cable, a second rear tilt cable, and a second set of cross cords supporting a second set of slats, at least one of said second front and rear tilt cables being connected to said tape drum, wherein rotation of said tape drum raises and lowers said one second tilt cable;

a first limit stop to limit rotation of said tape drum in a first direction about said axis;

a second limit stop to limit rotation of said tape drum in a second direction about said axis; and means for effecting a lag between the raising of one of said first front and rear tilt cables of said first ladder tape and one of said second front and rear tilt cables of said second ladder tape when said tape drum rotates about said longitudinal axis.

22. A tilter mechanism for selectively tilting portions of a covering for architectural openings as recited in claim 21, wherein said tape drum comprises a drive drum portion and a driven drum portion, wherein said drive drum portion has a first range of motion and drives said driven drum portion, and wherein said limit stops restrict the rotation of said driven drum to a second range of motion which is less than said first range of motion.

23. A tilter mechanism for selectively tilting portions of a covering for architectural openings as recited in claim 22, wherein said drive drum portion has first and second driving surfaces and said driven drum portion has first and second driven surfaces, and wherein rotation of said drive drum portion in said first direction causes said first driving surface to contact said first driven surface in order to drive said driven drum portion in said first direction, and wherein rotation of said drive drum portion in said second direction causes said second driving surface to contact said second driven surface in order to drive said driven drum portion in said second direction.

24. A tilter mechanism for selectively tilting portions of a covering for architectural openings as recited in claim 23, and further comprising:

a tape drum mounting cradle, wherein said tape drum is mounted for rotation relative to said cradle; and a cradle-impacting member on said driven drum portion, wherein said member contacts said cradle, at said first and second limit stops, for limiting rotation of said driven drum portion about said longitudinal axis.

25. A tilter mechanism for selectively tilting portions of a covering for architectural openings as recited in claim 24, wherein said first front and rear tilt cables of said first ladder tape are secured to said drive drum portion, and said second front and rear tilt cables of said second ladder tape are secured to said driven drum portion.

26. A tilter mechanism for selectively tilting portions of a covering for architectural openings as recited in claim 25, wherein said first range of motion of said tape drum is approximately 180 degrees.

27. A tilter mechanism for selectively tilting portions of a covering for architectural openings as recited in claim 26, wherein said driven drum portion further comprises a detent adjacent to said first driven surface, such that one of said first and second driving surfaces on said drive drum portion may also engage said detent to rotationally drive said driven drum portion.

28. A tilter mechanism for selectively tilting portions of a covering for architectural openings as recited in claim 26, and further comprising a torsional biasing spring which rotationally biases said driven drum portion in one of said first and second directions.

29. An attachment mechanism for securing a cord to a ladder tape, comprising:

at least one ladder tape including front and rear tilt cables and a plurality of cross cords extending between said front and rear tilt cables;

at least one actuator cord;

an elongated attachment clip having a front side, a rear side, a right side and a left side and defining:

a first through opening extending from said front side to said rear side, wherein said actuator cord is secured to said clip at said first through opening;

a first slotted opening extending from said front side to said rear side and open to said right side; and a second slotted opening extending from said front side to said rear side and open to said left side, wherein one of said front and rear tilt cables of said ladder tape is threaded through said first and second slotted openings.

30. An attachment mechanism for securing a cord to a ladder tape, comprising:

at least one ladder tape including a plurality of cross cords;

at least one actuator cord;

an elongated attachment clip having a front side, a rear side, a right side and a left side and defining:

a first through opening extending from said front side to said rear side, wherein said actuator cord is secured to said clip at said first through opening;

a first slotted opening extending from said front side to said rear side and open to said right side; and a second slotted opening extending from said front side to said rear side and open to said left side, wherein said ladder tape is threaded through said first and second slotted openings;

wherein said clip defines a third slotted opening intermediate said first and second slotted openings, extending from said front side to said rear side and open to one of said right and left sides, wherein one of said cross cords is threaded through said third slotted opening.

31. A tilter mechanism for selectively tilting portions of a covering for architectural openings, comprising:

a frame member;

a tape drum mounted for rotation about a longitudinal axis relative to said frame member;

at least one ladder tape including a front tilt cable and a rear tilt cable, at least one of said front and rear cables being connected to said tape drum, wherein rotation of said tape drum raises and lowers one of said front and rear tilt cables, and wherein said other of said front and rear tilt cables is secured to said frame member; and at least one actuator cord with a first point secured to said ladder tape along the length of one of said front and rear tilt cables, and a second point secured to said tape drum, wherein rotation of said tape drum raises and lowers said actuator cord.

32. A tilter mechanism for selectively tilting portions of a covering for architectural openings as recited in claim 31, and further comprising:

slats mounted to said ladder tape wherein rotation of said tape drum tilts said slats between a first end position wherein a first portion on said slats is open and a second portion of said slats is closed, and a second end position wherein said first and second portions of said slats are both closed, and wherein said tape drum rotates approximately 405 degrees between said first end position and said second end position of said slats.

* * * * *